US011180949B2

(12) United States Patent
Patock et al.

(10) Patent No.: US 11,180,949 B2
(45) Date of Patent: Nov. 23, 2021

(54) SEALING SYSTEM FOR OVERHEAD DOOR

(71) Applicant: Thermo Traks Inc, Spicer, MN (US)

(72) Inventors: John D. Patock, Spicer, MN (US); Carl J. Peterson, Hawick, MN (US)

(73) Assignee: THERMO TRAKS INC, Spicer, MN (US)

( * ) Notice: Subject to any disclaimer, the term of this patent is extended or adjusted under 35 U.S.C. 154(b) by 123 days.

(21) Appl. No.: 16/200,112

(22) Filed: Nov. 26, 2018

(65) Prior Publication Data

US 2019/0162015 A1 May 30, 2019

Related U.S. Application Data

(60) Provisional application No. 62/590,828, filed on Nov. 27, 2017.

(51) Int. Cl.

| | |
|---|---|
| ***E06B 7/16*** | (2006.01) |
| ***E06B 7/23*** | (2006.01) |
| ***E05D 15/24*** | (2006.01) |

(52) U.S. Cl.

CPC ..... *E06B 7/2305* (2013.01); *E05D 15/24* (2013.01); *E06B 7/231* (2013.01); *E06B 7/2309* (2013.01); *E06B 7/2314* (2013.01); *E05Y 2900/106* (2013.01); *E05Y 2900/132* (2013.01)

(58) Field of Classification Search

CPC ..... E06B 7/2305; E06B 7/231; E06B 7/2314; E05D 15/24; E05D 15/18; E05D 15/165; E05Y 2900/132; E05Y 2900/106

USPC ..... 49/197, 496.1, 500.1

See application file for complete search history.

(56) References Cited

U.S. PATENT DOCUMENTS

| | | | | | |
|---|---|---|---|---|---|
| 771,133 | A * | 9/1904 | edwards | E06B 7/22 | 49/493.1 |
| 1,763,603 | A * | 6/1930 | Donahue | B60J 10/70 | 296/93 |
| 2,106,322 | A * | 1/1938 | Harnly | E06B 7/231 | 49/493.1 |
| 2,591,833 | A * | 4/1952 | Krelmendahl | B60J 10/80 | 49/495.1 |
| 2,612,664 | A * | 10/1952 | Sidden | E06B 7/231 | 49/493.1 |

(Continued)

FOREIGN PATENT DOCUMENTS

| | | | | |
|---|---|---|---|---|
| CA | 3025549 A1 * | 5/2019 | ..... | E06B 7/2305 |
| GB | 2142073 A * | 1/1985 | ..... | E06B 7/231 |
| GB | 2211235 A * | 6/1989 | ..... | E06B 7/2314 |

OTHER PUBLICATIONS

"Q-Lon foam weatherseal: for PVC, timber and aluminum applications," Schlegel Q-Lon Brochure, www.schlegel.com, Sep. 2013, 36 pages.

(Continued)

*Primary Examiner* — Jerry E Redman

(74) *Attorney, Agent, or Firm* — Merchant & Gould P.C.

(57) ABSTRACT

A sealing system for a storage enclosure is disclosed. The sealing system includes a sealing member having a first sealing portion, and a second sealing portion that extends from the first sealing portion. The second sealing portion including a first leg and a second leg. The first leg extends from the first sealing portion at a first angle, and the second leg extends from the first sealing portion at a second angle. The second angle is larger than the first angle.

9 Claims, 17 Drawing Sheets

(56) References Cited

U.S. PATENT DOCUMENTS 2,757,422 A * 8/1956 Flicker ..... E06B 7/231 49/489.1
3,184,808 A * 5/1965 Lyon ..... E06B 7/231 49/493.1
3,456,390 A * 7/1969 Johnw ..... E06B 7/2312 49/489.1
3,788,008 A * 1/1974 Yackiw ..... B60J 10/16 49/496.1
4,115,973 A * 9/1978 Anderson ..... E06B 1/32 428/542.8
4,447,988 A * 5/1984 Cole ..... E06B 7/231 49/495.1
4,898,760 A * 2/1990 Halberstadt ..... B29C 66/7392 428/122
4,930,257 A * 6/1990 Windgassen ..... E06B 1/325 49/400
4,957,301 A * 9/1990 Clay, Jr. ..... B60J 5/14 160/40
5,347,759 A * 9/1994 Kobayashi ..... B60J 10/15 49/475.1
5,408,784 A * 4/1995 Wruck ..... E06B 3/308 49/489.1
5,435,104 A * 7/1995 Dietrich ..... B60J 5/14 49/475.1
6,314,683 B1 * 11/2001 Vesa ..... E06B 7/2301 49/496.1
6,374,567 B1 * 4/2002 Mullet ..... E06B 3/485 160/201
6,772,560 B2 * 8/2004 Dischiant ..... E06B 7/23 49/197
7,887,126 B2 * 2/2011 Grummett ..... B60J 10/82 296/216.06
8,146,985 B2 * 4/2012 Nelson ..... B60J 5/125 296/146.8
8,684,065 B2 4/2014 Peterson
8,881,464 B1 * 11/2014 Huckeba ..... E06B 1/6046 49/496.1
8,910,421 B2 * 12/2014 Potter ..... E06B 7/231 49/482.1
9,032,668 B2 * 5/2015 Blackwood ..... B60J 10/45 49/480.1
9,045,937 B2 * 6/2015 Peck ..... E06B 7/16
9,845,638 B1 * 12/2017 Cunningham ..... E06B 7/2314
9,982,478 B2 * 5/2018 Boer ..... E06B 7/2312
10,563,453 B2 * 2/2020 Steinke ..... E06B 7/2312
2006/0230685 A1 * 10/2006 Bellemare ..... B60R 13/04 49/496.1
2009/0084041 A1 * 4/2009 Foster ..... E06B 7/23 49/479.1
2011/0214352 A1 * 9/2011 Bellota ..... E06B 9/0607 49/197
2012/0304543 A1 * 12/2012 Preising, Jr. ..... E06B 7/2314 49/495.1

OTHER PUBLICATIONS

Garage Door Seals: Top and Side Seals, DDM Garage Doors, accessed Nov. 27, 2017, 6 pages.
EverMark 4-9/16 in. x 3.43 in. x 83 in. Primed Frame Set, The Home Depot Inc., accessed Nov. 27, 2017, 4 pages.
M-D Building Products 36 in. x 84 in. White Compression Door Jamb Weatherstrip Set with Wood Stop, The Home Depot Inc., accessed Nov. 27, 2017, 4 pages.
Frost King E/O 3 in. x 108 in. Top and Sides Vinyl Garage-Door Weather-Strip, The Home Depot Inc., accessed Nov. 27, 2017, 4 pages.
Frost King E/O 1 in. x 8 ft. White Vinyl-Covered Foam Weatherstrip Kerf Door Seal, The Home Depot Inc., accessed Nov. 27, 2017, 4 pages.
Frost King E/O 2 in. x 17 ft. Wood Thermo Plastic Door Set, The Home Depot Inc., accessed Nov. 27, 2017, 4 pages.

* cited by examiner

SEALING SYSTEM FOR OVERHEAD DOOR

CROSS-REFERENCE TO RELATED APPLICATIONS

This application claims priority to U.S. Provisional Patent Application 62/590,828 filed Nov. 27, 2017, the disclosure of which is incorporated herein by reference in its entirety.

BACKGROUND

Overhead doors are frequently used in commercial and residential buildings. Due to the movement of the overhead door during opening and closing, the overhead door is not directly connected to the opening like a conventional swing style door. Also, installing a seal around the area of the overhead door can inhibit the movement of the overhead door due to friction between the overhead door and the seal as the overhead door slides between open and closed positions. As a result, it can be difficult to properly seal the area around an overhead door.

SUMMARY

The present disclosure relates generally to a sealing system for a storage enclosure. In one aspect, the sealing system includes a sealing member having a first sealing portion, and a second sealing portion that extends from the first sealing portion. The second sealing portion includes a first leg and a second leg. The first leg extends from the first sealing portion at a first angle. The second leg extends from the first sealing portion at a second angle, and the second angle is larger than the first angle. In one example, the first leg of the second sealing portion is substantially orthogonal to the first sealing portion. In another example, the first angle is about 90 degrees and the second angle is in a range from 90 to 180 degrees. In another examples, the second angle is about 135 degrees.

The sealing system may further include a groove between the first leg and the second leg that defines a space when the second sealing portion is in an uncompressed state. The space defined by the groove is eliminated when the second sealing portion is in a compressed state.

The sealing system may further include a pressure sensitive adhesive on the first leg of the second sealing portion. In one example, the pressure sensitive adhesive is substantially orthogonal to the first sealing portion.

In one example, the first sealing portion has a tapered design. In one example, the first sealing portion and the second sealing portion are made from a compressible foam material.

The sealing system may further include an insert made of solid material. In one example, the insert has an elbow shape and extends between the first sealing portion and the first leg of the second sealing portion.

The sealing system may further include a backing plate made of solid material. In one example, the backing plate is configured to secure the first sealing portion to a side surface of an overhead door. In another example, the backing plate is configured to secure the first sealing portion to a side surface of a frame of an opening of the storage enclosure.

In one example, the sealing system is an extruded component. In some examples, the first sealing portion seals a space between a jamb and a frame of the storage enclosure, and the second sealing portion seals a space between an overhead door and the jamb.

In another aspect, the sealing system comprises a sealing member that includes a first sealing portion having a tapered design, and a second sealing portion that extends from the first sealing portion. The second sealing portion has a tubular shape that defines a hollow portion when the second sealing portion is in an uncompressed state. The sealing system further includes a pressure sensitive adhesive attached to a surface of the second sealing portion that is substantially orthogonal to the first sealing portion. In one example, the second sealing portion includes a sealing surface that includes a slip seal layer. In another example, the first sealing portion is configured to seal a space between a jamb and a frame of the storage enclosure, and the second sealing portion is configured to seal a space between an overhead door and the jamb.

A variety of additional aspects will be set forth in the description that follows. The aspects can relate to individual features and to combination of features. It is to be understood that both the foregoing general description and the following detailed description are exemplary and explanatory only and are not restrictive of the broad inventive concepts upon which the embodiments disclosed herein are based.

DETAILED DESCRIPTION

Figure 1:
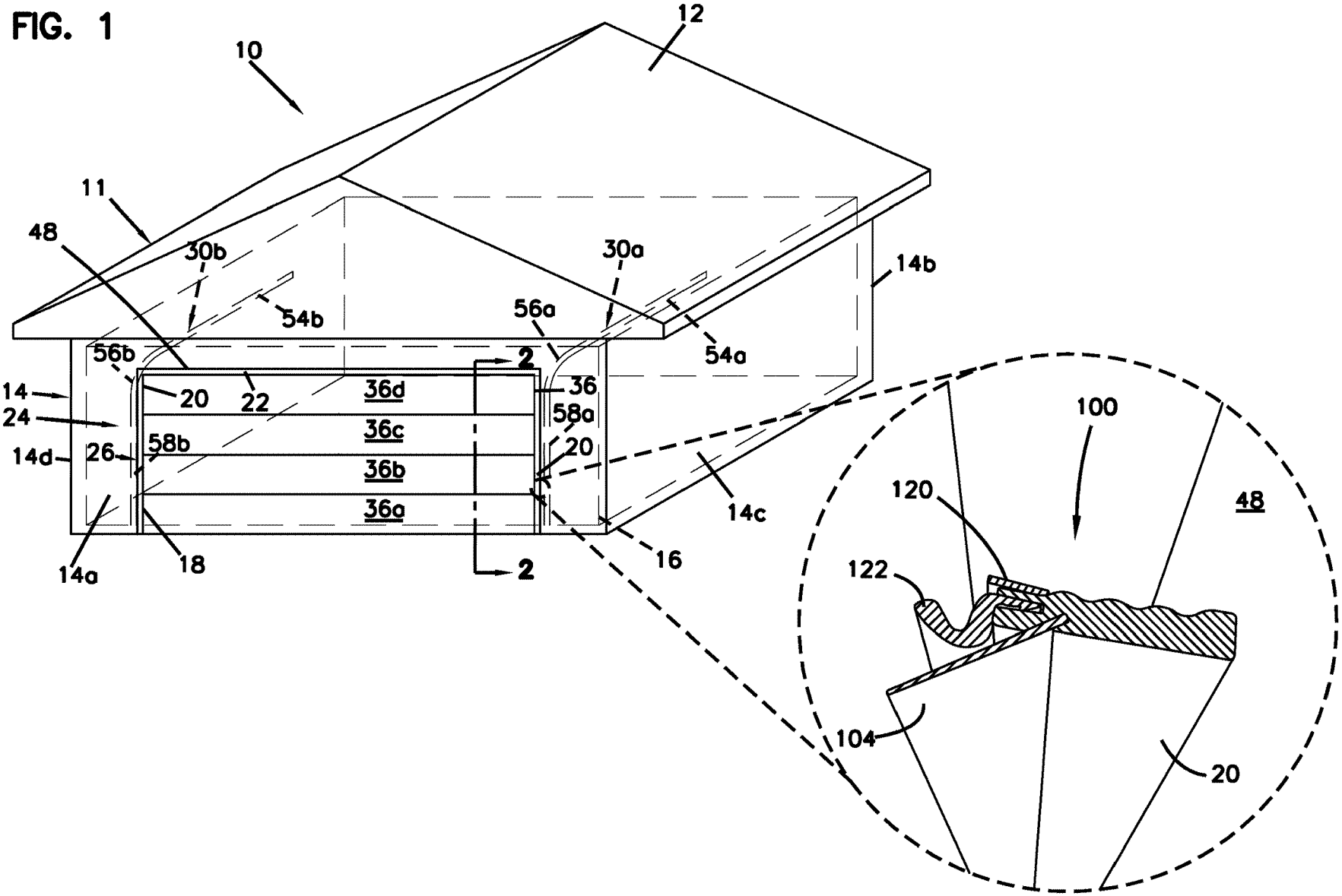
FIG. 1 is an isometric view of an exemplary storage enclosure that includes an enlarged view of a sealing system in accordance with the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

FIG. 1 is an isometric view of a storage enclosure 10 that includes an enlarged view of a sealing system 100 in accordance with one example of the present disclosure. In the depicted example in FIG. 1, the storage enclosure 10 is a garage. The interior 16 (shown as a dashed line in FIG. 1) is adapted to receive items (e.g., cargo, vehicles, etc.) and to shelter these items from the outside environment. The interior 16 is accessible through an opening 18 which is defined by a frame 48 that includes vertical jambs 20 and a horizontal header 22 that extends between the jambs 20 at the top of the opening 18. The descriptors "vertical", "horizontal", and "top" as used herein are not intended to limit the configuration of the opening 18. The opening 18 may be bound at the bottom by the floor of the storage enclosure 10 or the ground.

The sealing system 100 is attachable to the jambs 20 and the header 22 of the frame 48 of the storage enclosure 10. As shown in FIG. 1, the sealing system 100 includes a first sealing portion 120 and a second sealing portion 122. As also shown in FIG. 1, the jamb 20 includes a sealing member 104. The sealing system 100 including the first and second sealing portions 120, 122 will be described below in more detail with reference to FIGS. 9-13.

The storage enclosure 10 includes a roof 12 and a plurality of sidewalls 14. In one aspect, the plurality of sidewalls 14 includes a first sidewall 14*a*, an oppositely disposed second sidewall 14*b*, a third sidewall 14*c* and an oppositely disposed fourth sidewall 14*d*. The third and fourth sidewalls 14*c*, 14*d* extend between the first and second sidewalls 14*a*, 14*b*. In another aspect of the present disclosure, the first sidewall 14*a* is a front sidewall, the second sidewall 14*b* is a back sidewall, the third sidewall 14*c* is a left sidewall and the fourth sidewall 14*d* is a right sidewall. The roof 12 and the plurality of sidewalls 14 cooperatively define the interior 16. In one aspect of the present disclosure, the first sidewall 14*a* defines the opening 18.

Figure 2:
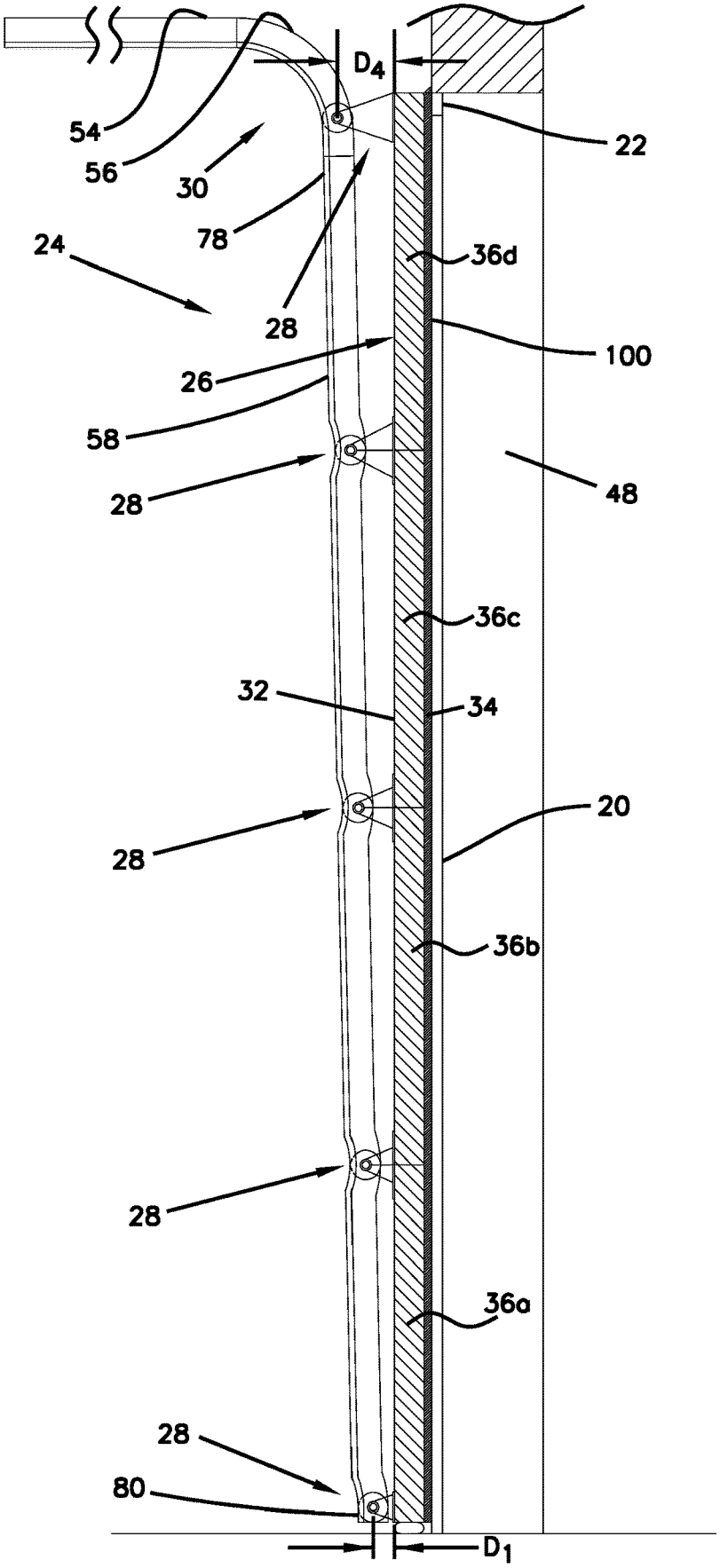
FIG. 2 is a cross-sectional view of an exemplary overhead door assembly suitable for use with the storage enclosure of FIG. 1 taken along line 2-2 of FIG. 1.

FIG. 2 is a cross-sectional view of an exemplary overhead door assembly 24 suitable for use with the storage enclosure 10 taken along line 2-2 of FIG. 1. As shown in FIGS. 1 and 2, the overhead door assembly 24 includes an overhead door 26, a plurality of roller assemblies 28, and an overhead door track assembly 30.

The overhead door 26 is selectively moveable between an open position and a closed position. In the open position, the overhead door 26 is fully raised so that the interior 16 of the storage enclosure 10 is accessible through the opening 18. In the closed position, the overhead door 26 is fully lowered so that the opening 18 of the storage enclosure 10 is blocked by the overhead door 26 thereby blocking access to the interior 16 through the opening 18.

The overhead door 26 includes an interior surface 32 and an exterior surface 34. When assembled to the storage enclosure 10, the interior surface 32 is directed towards the interior 16 of the storage enclosure 10 while the exterior surface 34 is directed towards the exterior of the storage enclosure 10. The overhead door 26 includes multiple panels 36. For example, the overhead door 26 includes a first panel 36*a*, a second panel 36*b*, a third panel 36*c*, and a fourth panel 36*d*. The overhead door 26 is not limited to the number of panels depicted in the figures, and the number of panels may vary as needed or desired for a particular application.

Figure 3:
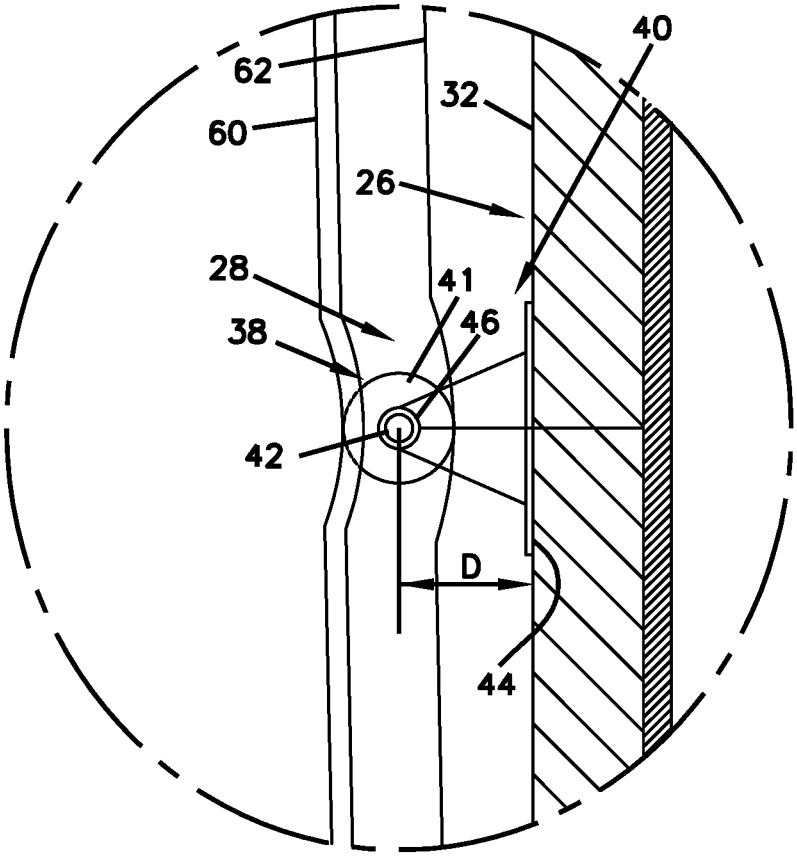
FIG. 3 is an enlarged fragmentary view of an exemplary roller assembly suitable for use with the overhead door assembly of FIG. 2.

FIG. 3 is an enlarged fragmentary view of a roller assembly 28 suitable for use with the overhead door assembly 24. Referring now to FIGS. 2 and 3, a plurality of roller assemblies 28 is mounted to the overhead door 26. The plurality of roller assemblies 28 are mounted to the interior surface 32 of the overhead door 26. In the depicted example embodiment of FIG. 2, the overhead door assembly 24 includes five roller assemblies 28. However, the overhead door assembly 24 is not limited to the number of roller assemblies depicted in the figures, and it can be appreciated that the number of roller assemblies may vary as needed or desired for a particular application. As depicted in the example embodiment of FIG. 3, each roller assembly 28 includes a roller 38 and a bracket 40. In one aspect of the present disclosure, each roller 38 includes a wheel 41 and a shaft 42. The shaft 42 is engaged to the wheel 41 at the center of the wheel 41.

The bracket 40 includes a mounting surface 44 and a roller mount 46 that extends outwardly from the mounting surface 44. The mounting surface 44 is adapted for mounting to the interior surface 32 of the overhead door 26. In one aspect of the present disclosure, the bracket 40 is mounted to the overhead door 26 by fasteners such as bolts, screws, and the like.

The roller mount 46 of the bracket 40 is pivotally engaged to the shaft 42 of the roller 38. With the shaft 42 engaged to the roller mount 46, the wheel 41 of the roller 38 rotates about an axis of the shaft 42 as the overhead door assembly 24 is raised and lowered. The roller mount 46 of the bracket 40 is offset from the mounting surface 44 of the bracket 40 by a distance D (shown in FIG. 3). The distance D varies depending on the location of the bracket 40 on the overhead door 26 (shown in FIG. 2). For example, the distance $D_4$ of the bracket 40 mounted on the fourth panel 36*d*, which is adjacent the header 22 when the overhead door 26 is in the closed position, is greater than the distance $D_1$ of the bracket 40 that is mounted to the first panel 36*a*. The reason for the variation in distance D will be described in greater detail below.

Figure 4:
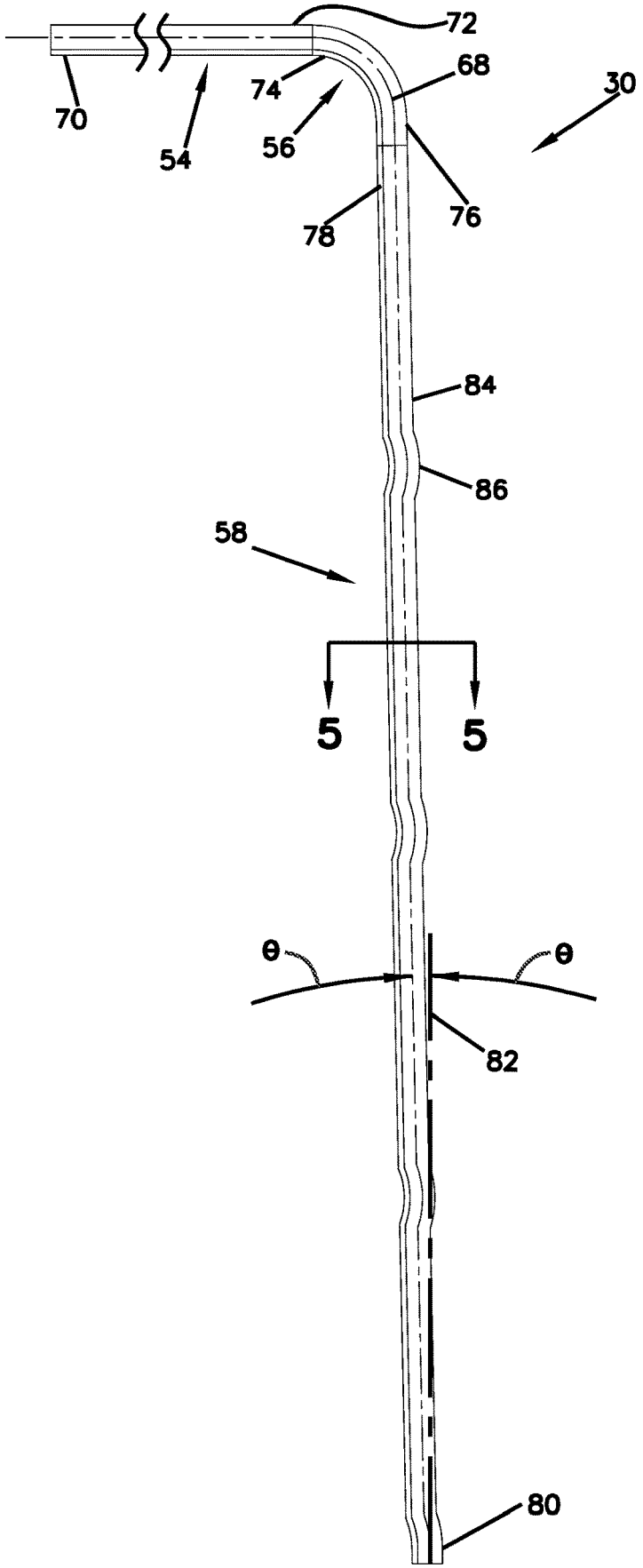
FIG. 4 is a side view of an exemplary overhead door track assembly suitable for use with the overhead door assembly of FIG. 2.

FIG. 4 is a side view of an exemplary overhead door track assembly 30 suitable for use with the overhead door assembly 24. Referring now to FIGS. 1, 2 and 4, the exemplary overhead door track assembly 30 is adapted for installation in the interior 16 of the storage enclosure 10. The overhead door track assembly 30 receives the wheels 41 of the roller assemblies 28, and guides the overhead door 26 as the overhead door 26 is raised and lowered.

FIGS. 5-8 illustrate additional views of the overhead door track assembly 30. The overhead door track assembly 30, as illustrated in FIGS. 2-8, is an exemplary overhead door track assembly, and it is to be understood that the overhead door 26 and the sealing system 100 may be used in a storage enclosure 10 having an overhead door track assembly that includes different characteristics and features. Accordingly, the overhead door track assembly 30 may vary as needed or desired for a particular application.

As shown in FIG. 1, the overhead door track assembly 30 includes a first overhead door track assembly 30*a* and a second overhead door track assembly 30*b*. The first overhead door track assembly 30*a* includes a first horizontal track 54*a*, a first transition track 56*a*, and a first vertical track 58*a* disposed adjacent to one side of the opening 18. The second overhead door track assembly 30*b* similarly includes a second horizontal track 54*b*, a second transition track 56*b*, and a second vertical track 58*b* disposed adjacent to an opposite side of the opening 18.

The first and second horizontal tracks 54*a*, 54*b* are similar, and will be referred to singularly and collectively as the horizontal track 54. Similarly, the first and second transition tracks 56*a*, 56*b* are substantially similar, and will be referred to singularly and collectively as the transition track 56. Also, the first and second vertical tracks 58*a*, 58*b* are substantially similar, and will be referred to singularly and collectively as the vertical track 58. Additionally, portions of the overhead door track assembly 30 are referred to using the terms "horizontal" and "vertical", and it is to be understood that these descriptors are for purposes of convenience only and are not intended to limit the configuration of the overhead door track assembly 30.

Figure 5:
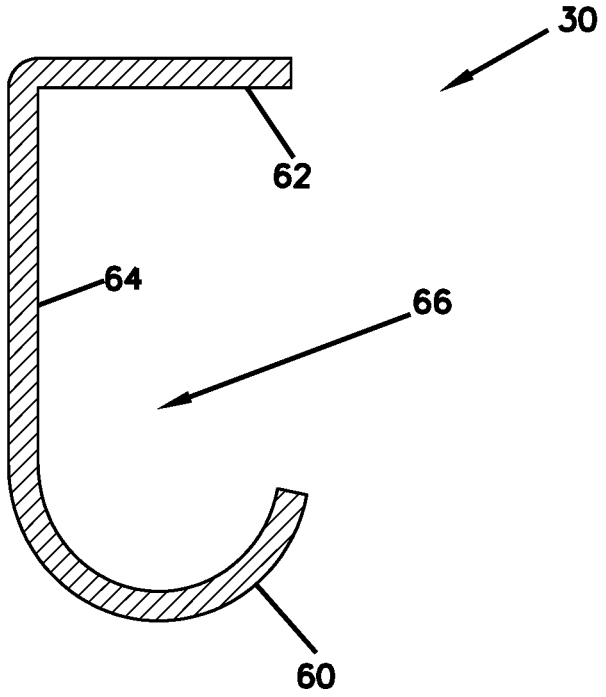
FIG. 5 is a cross-sectional view of the exemplary overhead door track assembly taken along line 5-5 in FIG. 4.
Figure 6:
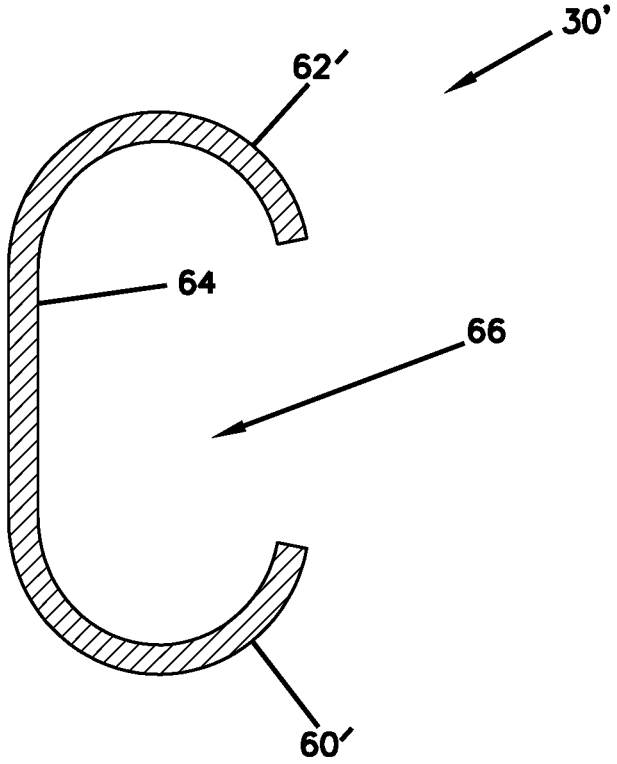
FIG. 6 is a cross-sectional view of an alternative overhead door track assembly.

FIG. 5 is a cross-sectional view of the exemplary overhead door track assembly 30. FIG. 6 is a cross-sectional view of an alternative overhead door track assembly 30'. Referring now to FIGS. 5 and 6, the cross-section of each of the horizontal track 54, the transition track 56, and the vertical track 58 includes a first edge 60, a second edge 62, and a side 64 that extends between the first and second edges 60, 62. In the example of FIG. 5, the first edge 60 is curved while the second edge 62 extends outwardly from the side 64 in a generally perpendicular direction. In the alternative example of FIG. 6, each of a first edge 60' and a second edge 62' is curved in the cross-section of each of the horizontal track 54, the transition track 56, and the vertical track 58.

The first and second edges 60, 62 and the side 64 of the overhead door track assembly 30 cooperatively define a channel 66. The channel 66 defines a path 68 (shown as a dashed line in FIG. 4). The wheels 41 of the roller assemblies 28 are guided along at least a portion of the path 68 as the overhead door assembly 24 is raised and lowered. The path 68 extends through the center of the channel 66 in a direction along the horizontal track 54, the transition track 56, and the vertical track 58. In one aspect of the present disclosure, the path 68 is substantially planar. The term "substantially planar" will be understood to account for deviations resulting from the manufacture and assembly of the horizontal, transition and vertical tracks.

Referring now to FIGS. 1-4, the horizontal track 54 is generally linear in shape and includes a first axial end 70 and an oppositely disposed second axial end 72. In one aspect of the present disclosure, the horizontal track 54 is mounted in the interior 16 of the storage enclosure 10 so that the horizontal track 54 is generally perpendicular to the first sidewall 14*a*.

The transition track 56 has a generally curved shape. For example, the transition track 56 has a substantially 90° elbow shape. The transition track 56 includes a first end 74 and a second end 76. In one aspect, the first end 74 is connected to the second axial end 72 of the horizontal track 54. In another aspect, the transition track 56 and the horizontal track 54 are integral.

The vertical track 58 includes a first end portion 78 and a second end portion 80. In one aspect, the first end portion 78 is connected to the second end 76 of the transition track 56. In another aspect, the vertical track 58 and the transition track 56 are integral.

The vertical track 58 is mounted in the interior 16 of the storage enclosure 10 adjacent to the opening 18 so that the vertical track 58 is substantially vertical. In one aspect, the vertical track 58 is disposed at an angular offset θ from a vertical reference plane 82 (shown as a dashed line in FIG. 4) that passes through the second end portion 80. Due to the angular offset θ, a distance between the first end portion 78 of the vertical track 58 and the vertical reference plane 82 is greater than a distance between the second end portion 80 and the vertical reference plane 82. As shown in FIG. 2, the vertical track 58 is disposed at the angular offset θ from the first sidewall 14*a* such that a distance between the first end portion 78 and the first sidewall 14*a* is greater than a distance between the second end portion 80 and the first sidewall 14*a*.

Figure 7:
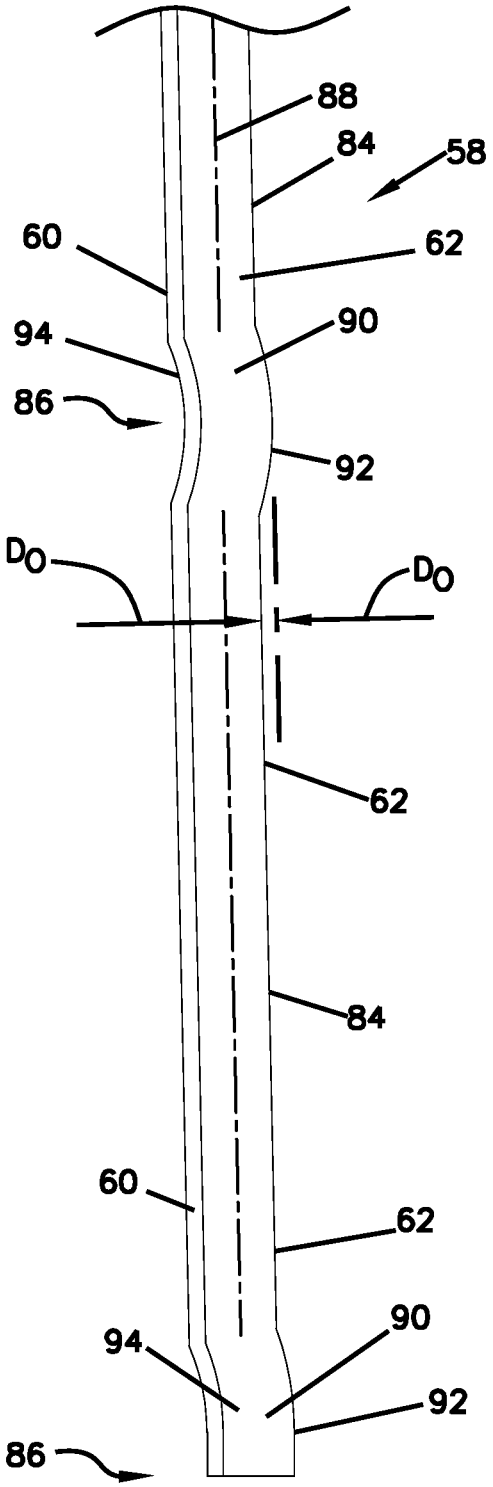
FIG. 7 is an enlarged fragmentary view of a vertical track of the exemplary overhead door track assembly of FIG. 4.

FIG. 7 is an enlarged fragmentary view of the vertical track 58. Referring now to FIGS. 2, 4 and 7, the vertical track 58 of the overhead door track assembly 30 includes a plurality of guide portions 84 and a plurality of jog portions 86. In one aspect of the present disclosure, each of the plurality of guide portions 84 is linear. The guide portions 84 cooperatively define a central longitudinal axis 88 that extends the length of the vertical track 58.

In one aspect of the present disclosure, the guide portions 84 and the jog portions 86 are alternately disposed along the vertical track 58. In one aspect of the present disclosure, the vertical track 58 includes at least three jog portions 86. In another aspect, the vertical track 58 includes four jog portions 86. In yet another aspect of the present disclosure, the number of jog portions 86 on the vertical track 58 is equal to one less than the number of rollers 38 mounted to the overhead door 26. In another aspect of the present disclosure, the number of jog portions 86 on the vertical track 58 is equal to the number of rollers 38 mounted to the overhead door 26.

As shown in FIG. 7, each of the jog portions 86 is a nonlinear portion of the vertical track 58 that can be formed or manufactured using a variety of possible techniques such as pressing, cutting, and bending, and the like. Each of the jog portions 86 includes an inclined portion 90 that extends outwardly from the guide portions 84 in a direction toward the opening 18 of the storage enclosure 10. The inclined portions 90 of the jog portions 86 extend outwardly from the guide portions 84 by an offset distance $D_O$. The offset distance $D_O$ is measured in a direction that is generally perpendicular to the central longitudinal axis 88 from the second edge 62 of an adjacent guide portion 84 of the vertical track 58 to an outermost portion of the second edge 62 of the jog portion 86. In one aspect of the present disclosure, the jog portions 86 are curved. In another aspect of the present disclosure, an outer surface 92 of the second edge 62 of each of the jog portions 86 is convex shaped (as depicted in FIG. 7) while an outer surface 94 of the first edge 60 of each of the jog portions 86 is concave shaped (as depicted in FIG. 7).

Figure 8:
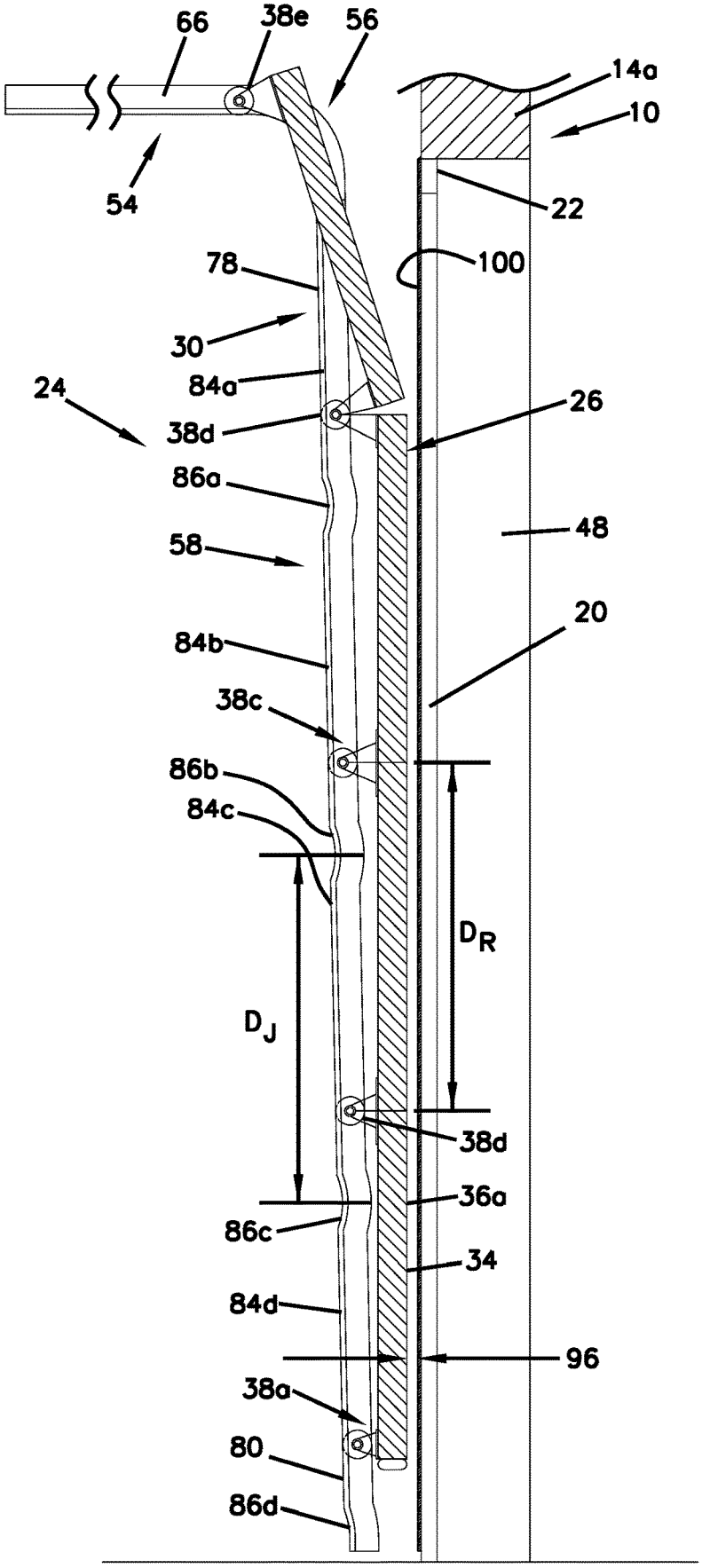
FIG. 8 is a cross-sectional view of the overhead door assembly of FIG. 2 with an overhead door in a partially opened position.

FIG. 8 is a cross-sectional view of the overhead door assembly 24 with the overhead door 26 in a partially opened position. Referring now to FIG. 8, a distance $D_J$ between the jog portion 86*b* and an adjacent jog portion 86*c* is equal to a distance $D_R$ between the corresponding roller 38*c* and a corresponding adjacent roller 38*b* of the overhead door assembly 24.

Referring now to FIGS. 4, 7, and 8, the operation of the overhead door assembly 24 will be described. With the overhead door 26 in the open position, the rollers 38 are disposed in the channel 66 of the horizontal track 54 of the overhead door track assembly 30. As the overhead door 26 is moved to the closed position, the rollers 38 follow the path 68 from the horizontal track 54 through the transition track 56 to the vertical track 58.

At the vertical track 58, a first roller 38*a*, which is engaged to the first panel 36*a* of the overhead door 26, passes through the first end portion 78 of the vertical track 58 and into a first guide portion 84*a* of the vertical track 58. As the overhead door 26 moves downwardly toward the closed position, the first roller 38*a* passes through a first jog portion 86*a*. At an outermost portion of the first jog portion 86*a*, the first roller 38*a* is displaced from the central longitudinal axis 88 of the guide portions 84 in a direction toward the opening 18 of the storage enclosure 10 by the offset distance $D_O$. As the overhead door 26 moves downwardly toward the closed position, the first roller 38*a* passes through a second guide portion 84*b* of the vertical track 58, a second jog portion 86*b*, a third guide portion 84*c*, a third jog portion 86*c*, a fourth guide portion 84*d*, and a fourth jog portion 86*d*. In the depicted embodiment of FIG. 8, at least one of the jog portions (e.g., the second jog portion 86*b*) is equidistant from the adjacent jog portions (e.g., the first and third jog portions 86*a*, 86*c*) along the vertical track 58.

When the overhead door 26 is in the closed position (see FIG. 2), the plurality of rollers 38 are at rest in the corresponding plurality of jog portions 86, and the overhead door 26 is offset from the central longitudinal axis 88 of the vertical track 58 of the overhead door track assembly 30 in a direction toward the first sidewall 14*a* of the storage enclosure 10.

As the overhead door 26 moves downwardly from the open position to the closed position or upwardly from the closed position to the open position, a clearance 96 is formed between the exterior surface 34 of the overhead door 26 and the sealing system 100. As previously described, the vertical track 58 is disposed at the angular offset with respect to the first sidewall 14*a* so that the distance between the first end portion 78 and the first sidewall 14*a* is greater than the distance between the second end portion 80 and the first sidewall 14*a*. In addition, the distance $D_1$ between the mounting surface 44 and the roller mount 46 of the bracket 40 mounted to the first panel 36*a* is less than the distance $D_4$ of the bracket 40 mounted to the fourth panel 36*d*. The angular offset θ of the vertical track 58 and the distance between the mounting surface 44 and the roller mount 46 cooperatively define the clearance 96. The clearance 96 is advantageous as it prevents the overhead door 26 from scrapping the sealing system 100 (described in more detail below) as the overhead door 26 is closed and opened.

With the overhead door 26 in the closed position, the clearance 96 between the exterior surface 34 of the overhead door 26 and the sealing system 100 is eliminated. The elimination in the clearance 96 is due to the jog portions 86 in the vertical track 58 offsetting the overhead door 26 from the central longitudinal axis 88 of the vertical track 58 in a direction toward the sealing system 100. In fact, the exterior surface 34 of the overhead door 26 pushes against and compresses the sealing system 100 which reduces air flow between the interior 16 and the exterior of the storage enclosure 10. Advantageously, this can help to improve the energy efficiency of the storage enclosure 10.

Figure 9:
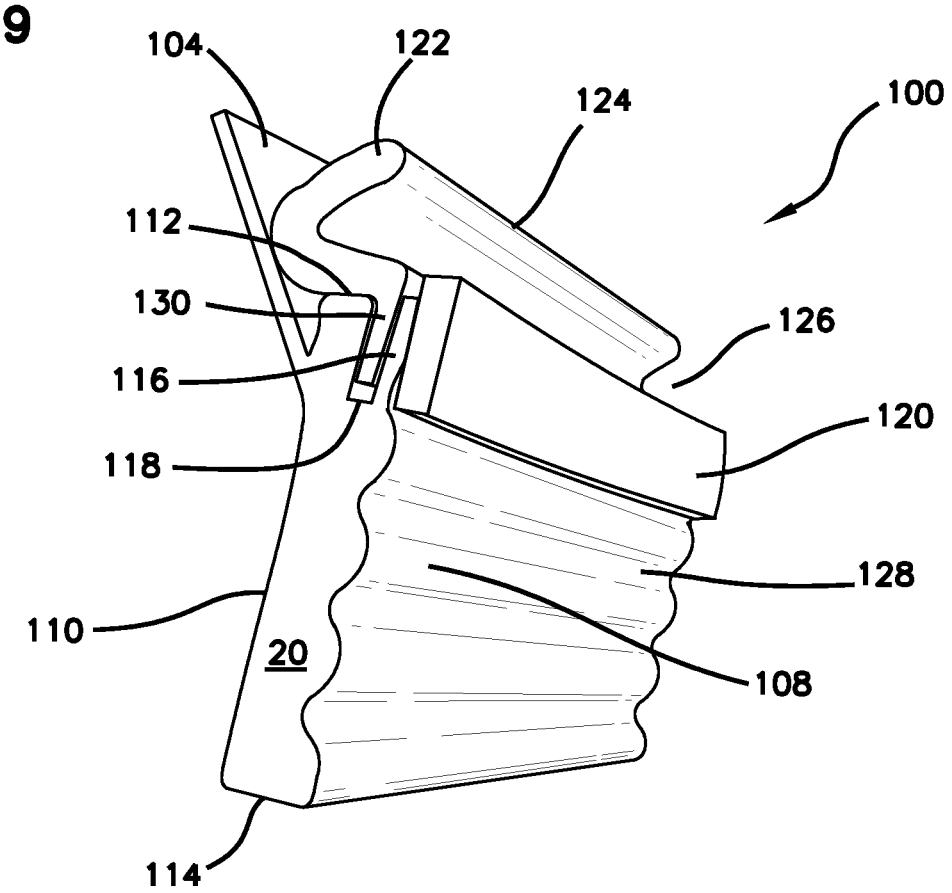
FIG. 9 is an isometric view of an example configuration of a sealing system having exemplary features in accordance with the present disclosure.
Figure 10:
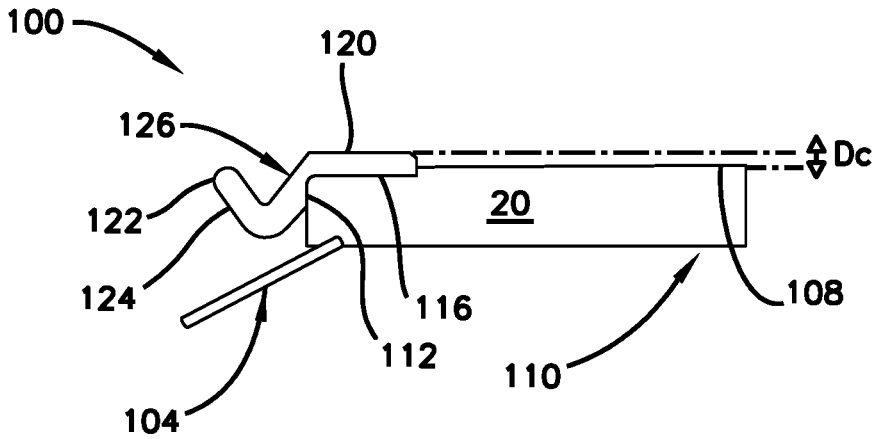
FIG. 10 is a cross-sectional view of the sealing system of FIG. 9.

FIG. 9 is an isometric view of a first example configuration of the sealing system 100 mounted to a jamb 20. FIG. 10 is a cross-sectional view of the sealing system 100 mounted to the jamb 20. As shown in FIGS. 9 and 10, jamb 20 has a first face 108 and an oppositely disposed second face 110. The jamb 20 further includes a first side 112 and an oppositely disposed second side 114 that extend between the first and second faces 108, 110. The first side 112 stops the outward movement of the overhead door 26 as the clearance 96 between the exterior surface 34 of the overhead door 26 and the first side 112 of the jamb 20 is reduced when the overhead door 26 is moved from the open position to the closed position. In the examples depicted in the figures, the jamb 20 has a rectangular cross-sectional shape; however, the shape of the jamb 20 may vary as needed or desired for a particular application, and accordingly, the jamb 20 is not limited to a rectangular cross-sectional shape. The first face 108 of the jamb 20 may include one or more channels 128. The channels 128 eliminate material from the jamb 20 and may thus reduce the weight and the amount of material used for the jamb 20.

The sealing system 100 includes the first sealing portion 120 and the second sealing portion 122. In one example aspect of the present disclosure, the first and second sealing portions 120, 122 are integral. In another example aspect of the present disclosure, the first and second sealing portions 120, 122 are separate pieces.

As shown in FIG. 10, the first sealing portion 120 can be embedded in a recess 116 on the first face 108 of the jamb 20. The first sealing portion 120 extends a distance $D_C$ beyond the plane of the first face 108 of the jamb 20 when in a non-compressed state (e.g., before installation of the sealing system 100). The first sealing portion 120 extends in a direction substantially parallel to the first face 108 of the jamb 20.

In the example depicted in FIG. 9, the jamb 20 includes an optional slot 118. The slot 118 is located on the first side 112, and receives at least a portion of the second sealing portion 122. The second sealing portion 122 has an appendage 130 that is received by the slot 118. The slot 118 may improve the adhesion of the sealing system 100 to the jamb 20. In alternative examples (e.g., the example shown in FIG. 10), the jamb 20 does not include the slot 118.

As shown in FIG. 10, a groove 126 extends between the first sealing portion 120 and the second sealing portion 122. The second sealing portion 122 includes a sealing surface 124 that extends in a direction away from the sealing member 104 of the jamb 20.

In alternative examples describe in more detail below, the sealing surface 124 extends in a direction toward the sealing member 104 of the jamb 20. In such alternative examples, the groove 126 is disposed on an opposite side such that the second sealing portion 122 folds in an opposite direction when compressed by the overhead door 26 as the clearance 96 between the exterior surface 34 of the overhead door 26 and the first side 112 of the jamb 20 is reduced.

The sealing member 104 of the jamb 20 extends outwardly from the jamb 20. In one aspect of the present disclosure, the sealing member 104 is embedded in the second face 110 of the jamb 20 and extends at an angle with respect to the second face 110.

In one example embodiment, the sealing member 104 and the jamb 20 are extruded together. For example, the sealing member 104 and the jamb 20 are extruded through a co-extrusion process that uses multiple extruders for integrating the sealing member 104 into the jamb 20. Thus, the sealing member 104 may be fed into the jamb 20 during an extrusion process so that the sealing member 104 is permanently captured by the jamb 20.

The sealing system 100 is attached to the jamb 20 after the extrusion process is completed. In some examples, the sealing system 100 is attached to the jamb 20 using an adhesive, heat sealing, or other means of attachment for securing the sealing system 100 into a saw kerf in the jamb 20 such as the optional slot 118.

In this example aspect, the sealing system 100 and the jamb 20 each retain their original properties in an integrated one-piece sealing system. The integration of the sealing system 100 and the jamb 20 into a one-piece sealing system simplifies the installation of the sealing system 100 onto the jamb 20 because it eliminates the need to secure the sealing system 100 and the sealing member 104 to the jamb 20 at the site of installation (e.g., the storage enclosure 10). Also, integration of the sealing system 100 and the sealing member 104 and the jamb 20 into a one-piece sealing system eliminates the need to caulk the jamb 20 after installation.

Certain materials for the sealing system 100, the sealing member 104, and the jamb 20 are advantageous. Such materials allow these components to adhere together and prevent degradation. For example, the sealing system 100 may have an interior made from a flexible foam material such as a polyurethane foam or similar material. Additionally, the sealing system 100 may have an exterior made from a waterproof layer of material such as, for example, a polyethylene film or similar material. In one example embodiment, the sealing system 100 is coated with a material that inhibits the second sealing portion 122 from sticking and/or freezing to the overhead door 26 of the storage enclosure 10. For example, the second sealing portion 122 may be coated with a nylon, Teflon, or similar type of coating material.

The sealing member 104 of the jamb 20 may be made from a flexible vinyl material. The flexible vinyl material allows the sealing member 104 to conform to the shape of the exterior surface 34 of the overhead door 26 when the overhead door 26 is in the closed position.

The jamb 20 may be made from a solid material such as, for example, polyvinyl chloride (PVC) or similar material. The solid material allows the jamb 20 to act as a stop against the overhead door 26 that prevents the overhead door 26 from moving beyond the exterior of the storage enclosure 10 when the overhead door 26 is moved to the closed position.

In one example embodiment, a middle layer of adhesive material may be inserted between the material used for the jamb 20 and the material used for the sealing system 100 and the sealing member 104 to improve the adhesion of these components after installation.

Figure 11:
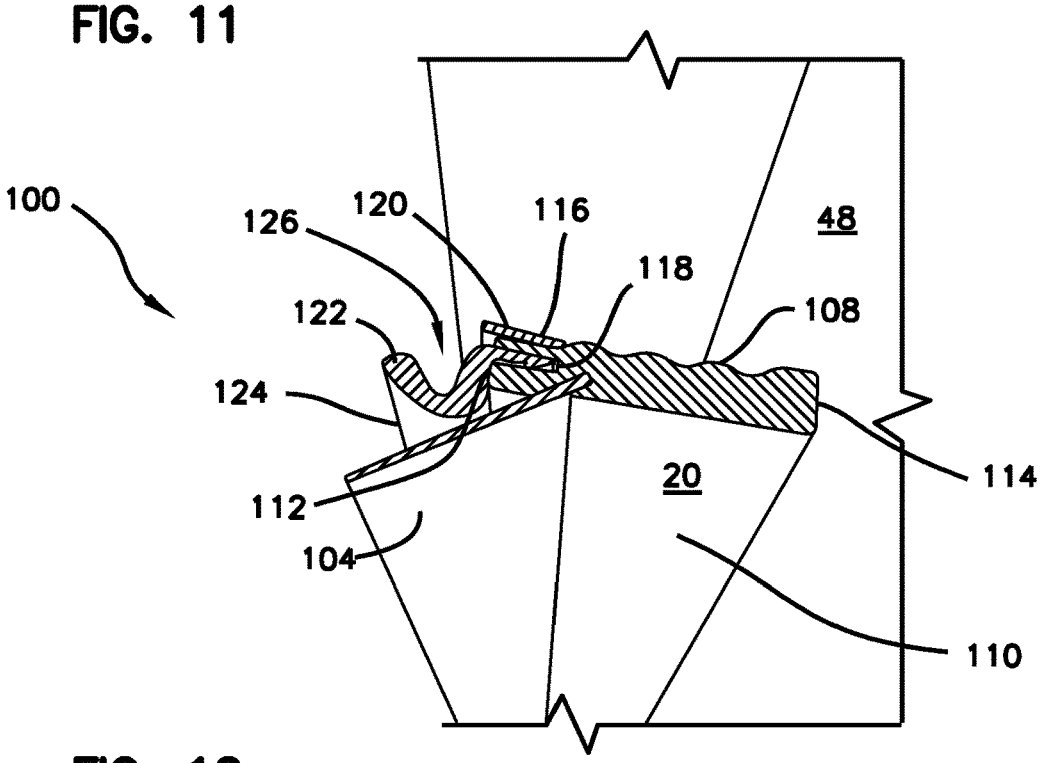
FIG. 11 is an isometric view of the sealing system of FIG. 9 installed between a frame and a jamb.
Figure 12:
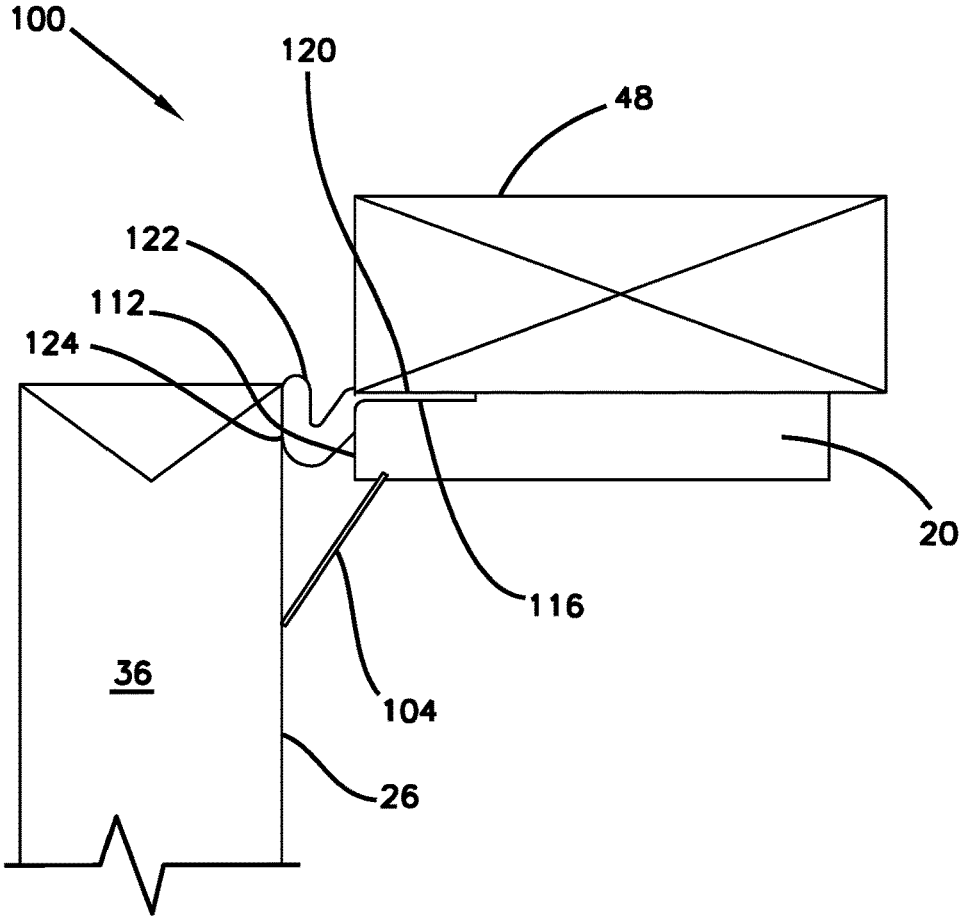
FIG. 12 is a cross-sectional-view of the sealing system of FIG. 9 installed between an overhead door and a jamb.

FIG. 11 is an isometric view of the sealing system 100 installed between the jamb 20 and the frame 48 of the storage enclosure 10. FIG. 12 is a cross-sectional-view of the sealing system 100 installed between the jamb 20 and the overhead door 26. Referring now to FIGS. 11 and 12, the first sealing portion 120 of the sealing system 100 is mounted between the jamb 20 and the frame 48. The length of the sealing system 100 can be any suitable length that matches the length of the jamb 20, and the length of the sealing system 100 can be cut for matching the length of the jambs 20. A separate sealing system 100 may be mounted to each jamb 20 of the frame 48.

When installed, the first sealing portion 120 is sandwiched between the jamb 20 and the frame 48, while the first side 112 of the jamb 20 faces the interior 16 of the storage enclosure 10 so that the first side 112 stops the outward movement of the overhead door 26 when the overhead door 26 is moved from the open position to the closed position. The jamb 20 may be fixed to the frame 48 using fasteners such as screws, nails, staples, and the like.

As shown in FIGS. 11 and 12, the first sealing portion 120 of the sealing system 100 occupies a space between the jamb 20 and the frame 48. In one example aspect of the present disclosure, the first sealing portion 120 acts as an insulator between the jamb 20 and the frame 48. This reduces air flow between the interior 16 and the exterior of the storage enclosure 10, and accordingly, may help improve the energy efficiency of the storage enclosure 10. This may also reduce the time and cost for installation of the jamb 20 because it reduces or eliminates the need to caulk/seal the jamb 20 after it is fixed to the frame 48.

Referring now to FIG. 12, the sealing surface 124 of the second sealing portion 122 contacts the exterior surface of the overhead door 26 when the overhead door 26 is in the closed position (FIG. 12 depicts a cross-sectional view of one of the panels 36 of the overhead door 26). As described above, the jog portions 86 in the vertical track 58 position the overhead door 26 toward the first side 112 of the jamb 20 and reduce the clearance 96 between the overhead door 26 and the first side 112 of the jamb 20. This causes the overhead door 26 to compress the second sealing portion 122 to seal the space between the overhead door 26 and the jamb 20. This reduces air flow between the interior 16 and the exterior of the storage enclosure 10, and advantageously may help to improve the energy efficiency of the storage enclosure 10.

Still referring to FIG. 12, when the overhead door 26 is moved to the closed position, the overhead door 26 also pushes against the sealing member 104 of the jamb 20. The sealing member 104 flexes when pushed by the overhead door 26, and thereby forms a second seal between the overhead door 26 and the jamb 20. This can further reduce air flow between the interior and exterior of the storage enclosure 10.

Figure 13:
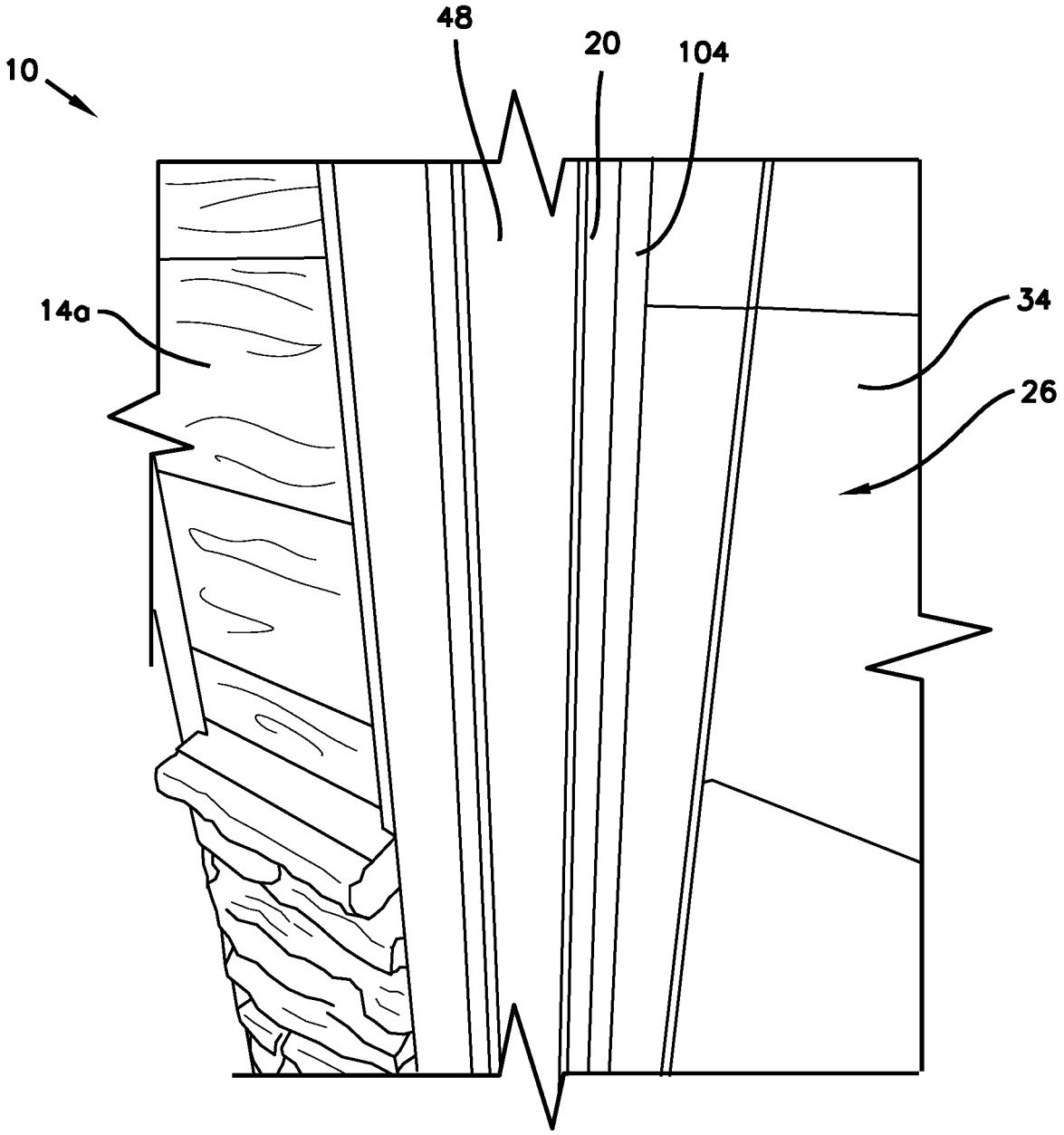
FIG. 13 is an isometric exterior view of the sealing system when an overhead door of the storage enclosure is in a closed position.

FIG. 13 is an isometric exterior view of the overhead door 26 of the storage enclosure 10 in a closed position. Referring now to FIG. 13, the sealing member 104 of the jamb 20 is in contact with the exterior surface 34 of the overhead door 26. The jamb 20 runs along the length of the frame 48 which is depicted on the first sidewall 14*a* of the storage enclosure 10. As described above, the sealing member 104 seals the space between the overhead door 26 and the jamb 20, and reduces air flow between the interior and exterior of the storage enclosure 10.

Although the sealing system 100 has been described relative to the jamb 20 and the frame 48, it is also contemplated that the sealing system 100 may be fixed to the horizontal header 22 of the frame 48 as well. In this case, the sealing system 100 can be attached to the header 22 and operate in a substantially similar manner as described above. Accordingly, the sealing system 100 may be attached to each side of the opening 18 of the storage enclosure 10 (e.g., the vertical jambs 20 and the horizontal header 22 of the frame 48).

Also, the sealing system 100 has been described as being used for sealing a storage enclosure such as garage; however, it is contemplated that the sealing system 100 can also be used in additional types of storage enclosures such as, for example, an insulated storage enclosure that utilizes an overhead door at the rear of a refrigerated truck.

Figure 14:
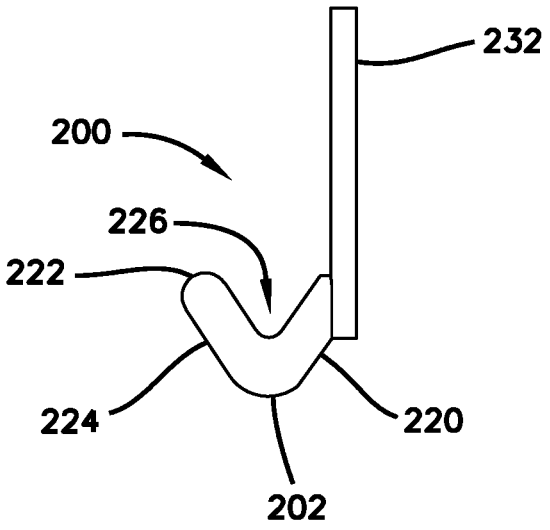
FIG. 14 is a cross-sectional view of an alternative configuration for the sealing system having exemplary features in accordance with the present disclosure.

FIG. 14 is a cross-sectional view of another example of a sealing system 200 having exemplary features in accordance with the present disclosure. FIG. 14 is a cross-sectional view of the sealing system 200 installed between an overhead door 26 and a frame 48. Referring now to FIGS. 13 and 14, the sealing system 200 includes a sealing member 202 having a first sealing portion 220 and a second sealing portion 222. The first sealing portion 220 is attached to a backing plate 232 while the second sealing portion 222 extends from the first sealing portion 220. The second sealing portion 222 has a sealing surface 224 that extends in a direction away from the sealing member 104 of the jamb 20 when the sealing system 200 is installed. A groove 226 extends between the first and second sealing portions 220, 222.

In some examples, the sealing member 202 and the backing plate 232 are extruded together such that they are integrated into a single piece of material. In other examples, the sealing member 202 and the backing plate 232 are made from different materials that are attached together by an adhesive such as glue or double-sided tape, or by one or more fasteners including screws, nails, staples, and the like.

In the example shown in FIG. 14, the sealing system 200 allows the sealing member 202 to be installed to the frame 48 independent of the jamb 20. Thus, the sealing system 200 can be used to retrofit an existing storage enclosure that has a frame and jamb already installed.

In the sealing system 200, the sealing member 202 provides a seal between the overhead door 26, the jamb 20, and frame 48. The backing plate 232 can be attached to an interior surface of the frame 48 that is perpendicular to the first face 108 of the jamb 20. The backing plate 232 can be made from a plastic or metal material, and can be attached to the frame 48 using by an adhesive such as a pressure sensitive adhesive, conventional adhesives such as glue or double-sided tape, or fasteners such as screws, nails, staples, and the like. In some examples, a distal end of the backing plate 232 and sealing member 202 extends beyond the surface of the frame 48.

Figure 15:
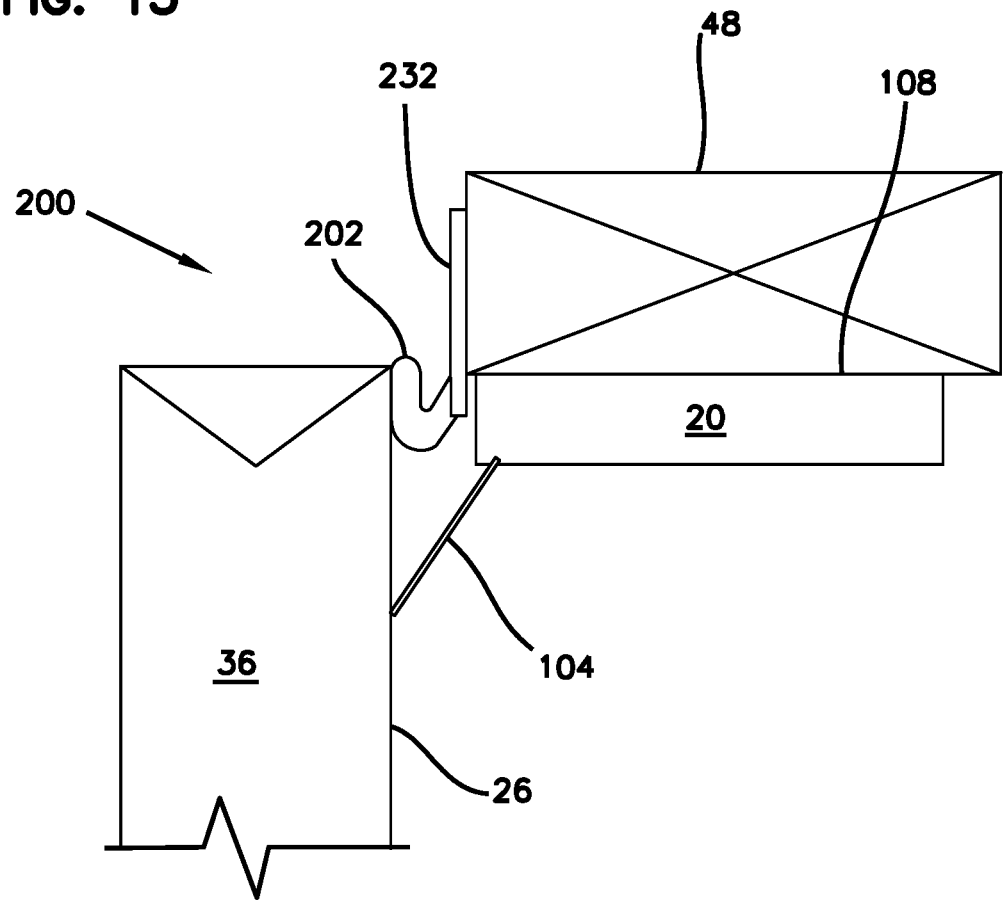
FIG. 15 is a cross-sectional view of the alternative configuration of FIG. 14 installed between an overhead door and a frame.
Figure 16:
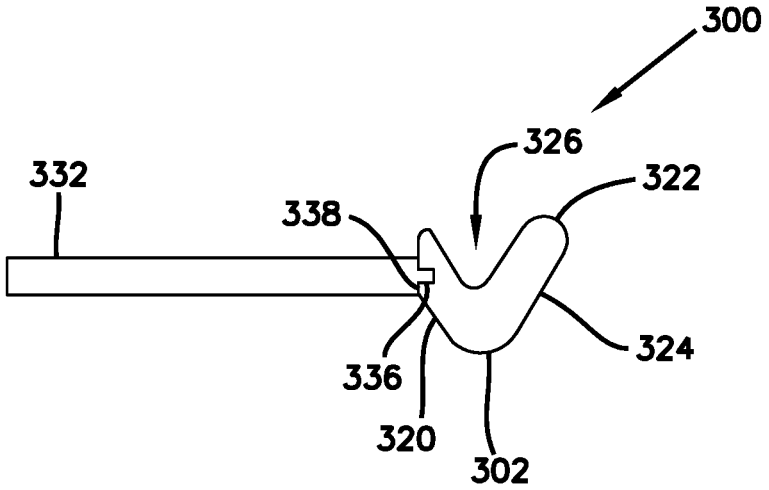
FIG. 16 is a cross-sectional view of another alternative configuration for the sealing system having exemplary features in accordance with the present disclosure.

FIG. 15 is a cross-sectional view of another example of a sealing system 300 having exemplary features in accordance with the present disclosure. FIG. 16 is a cross-sectional view of the sealing system 300 installed between an overhead door 26 and a frame 48. Referring now to FIGS. 15 and 16, the sealing system 300 includes a sealing member 302 having a first sealing portion 320 and a second sealing portion 322. The first sealing portion 320 is attached to a backing plate 332 while the second sealing portion 322 extends from the first sealing portion 320. The second sealing portion 322 has a sealing surface 324 that extends in a direction away from the sealing member 104 of the jamb 20 when the sealing system 300 is installed (see FIG. 16). A groove 326 extends between the first and second sealing portions 320, 322. When the overhead door 26 is moved to the closed position, the sealing member 302 provides a seal between the overhead door 26, the jamb 20, and frame 48.

In some examples, the sealing member 302 and the backing plate 332 are extruded together such that they are integrated into a single piece of material. In other examples, the sealing member 302 and the backing plate 332 are made from different materials that are attached together by an adhesive such as glue or double-sided tape, or by one or more fasteners including screws, nails, staples, and the like.

In the sealing system 300, the first sealing portion 320 includes a notch 336 that receives a dowel rod 338 of the backing plate 332. In FIG. 16, the backing plate 332 is attached to a side surface of each panel 36 of the overhead door 26 that is parallel to the first face 108 of the jamb 20. Thus, the sealing system 300 allows the sealing member 302 to be installed to the overhead door 26 independent of the frame 48 and the jamb 20 such that the sealing system 300 can be used to retrofit an existing storage enclosure that has a frame and jamb already installed.

The backing plate 332 can be made from a plastic or metal material, and can be attached to a side surface of each panel 36 of the overhead door 26 by an adhesive such as a pressure sensitive adhesive, conventional adhesives such as glue or double-sided tape, or fasteners such as screws, nails, staples, and the like. When attached to the overhead door 26, the sealing member 302 extends beyond the exterior surface of the overhead door 26.

Figure 17:
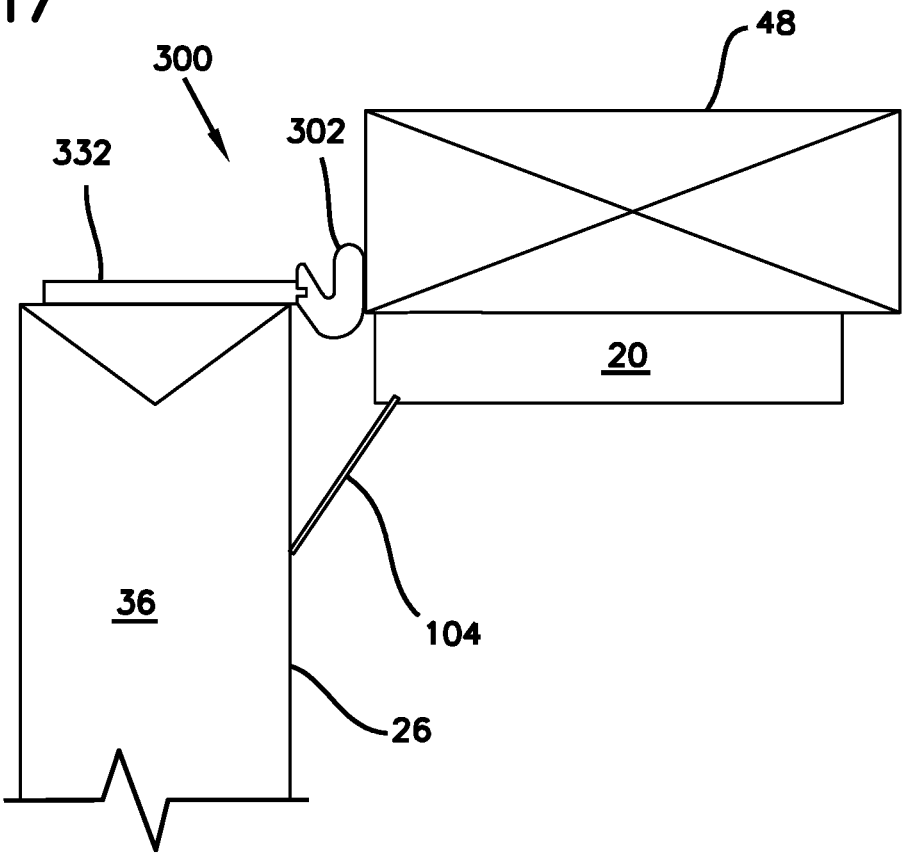
FIG. 17 is a cross-sectional view of the alternative configuration of FIG. 16 installed between an overhead door and a frame.
Figure 18:
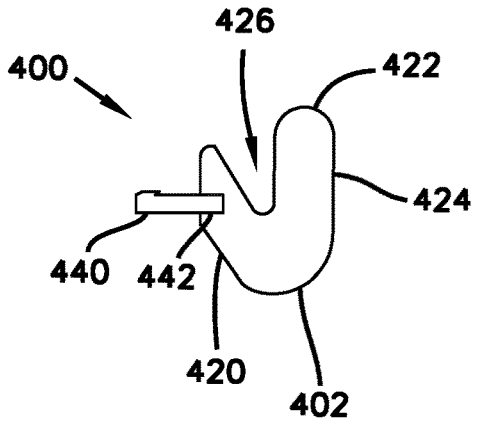
FIG. 18 is a cross-sectional view of another alternative configuration for the sealing system having exemplary features in accordance with the present disclosure.
Figure 19:
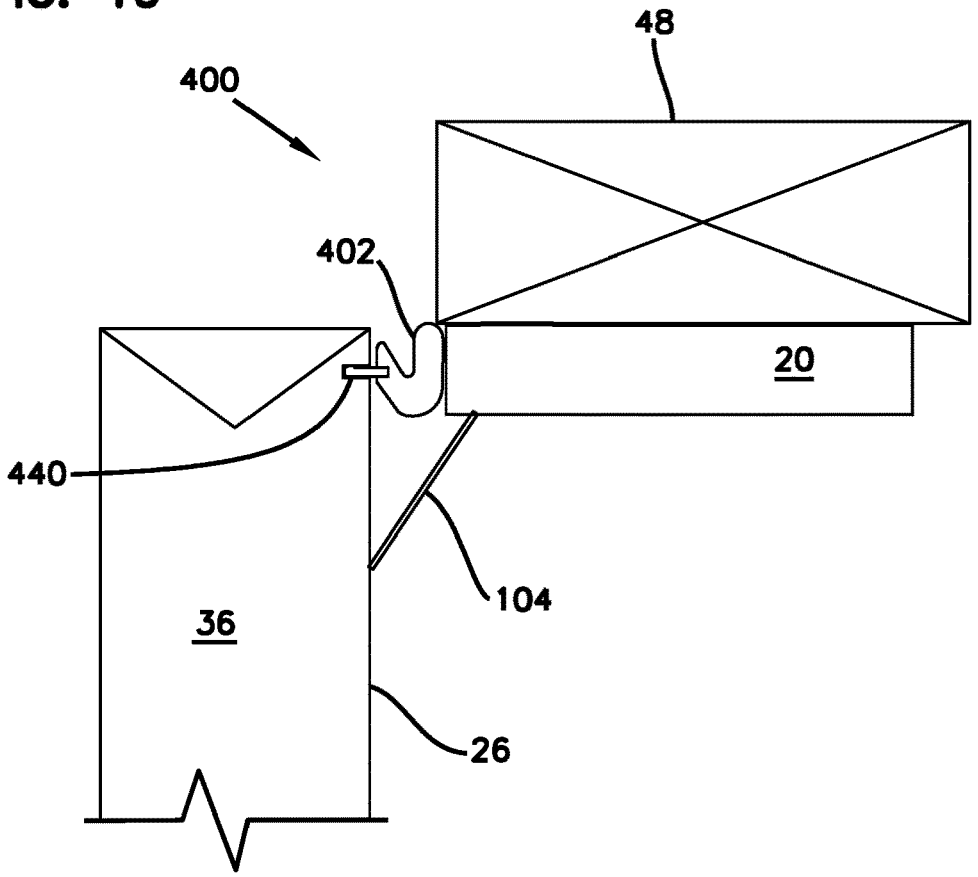
FIG. 19 is a cross-sectional view of the alternative configuration of FIG. 18 installed between an overhead door and a jamb.

FIG. 17 is a cross-sectional view of another example of a sealing system 400 having exemplary features in accordance with the present disclosure. FIG. 18 is a cross-sectional view of the sealing system 400 installed between an overhead door 26 and a jamb 20. Referring now to FIGS. 17 and 18, the sealing system 400 includes a sealing member 402 having a first sealing portion 420 and a second sealing portion 422. The first sealing portion 420 is attached to a spline 440, while the second sealing portion 422 extends from the first sealing portion 420. The second sealing portion 422 includes a sealing surface 424 that extends in a direction away from the sealing member 104 of the jamb 20 when the sealing system 400 is installed (see FIG. 18). A groove 426 extends between the first and second sealing portions 420, 422.

In some examples, the sealing member 402 and the spline 440 are extruded together such that they are integrated into a single piece of material. In other examples, the sealing member 202 and the backing plate 232 are made from different materials that are attached together by an adhesive such as glue or double-sided tape, or by one or more fasteners.

In sealing system 400, the first sealing portion 420 includes a groove 442 that receives the spline 440. The spline 440 is insertable into a mechanical groove or kerf on the exterior surface of the overhead door 26. The spline 440 may also be attached to the exterior surface of the overhead door 26 by an adhesive such as glue or double-sided tape, and the like. The spline 440 can be made from a plastic or metal material.

In the sealing system 400, a spline 440 can be attached to each panel 36 of the overhead door 26 (e.g., panels **36*a*-36*d* in FIG. 1). When attached to the overhead door 26, the sealing member 402 extends beyond the exterior surface of the door. The sealing system 400 allows the sealing member 402 to be installed to the overhead door 26 independent of the frame 48 and the jamb 20. When the overhead door 26 is moved to the closed position, the sealing member 402 provides a seal between the overhead door 26, the jamb 20, and the frame 48**.

Figure 20:
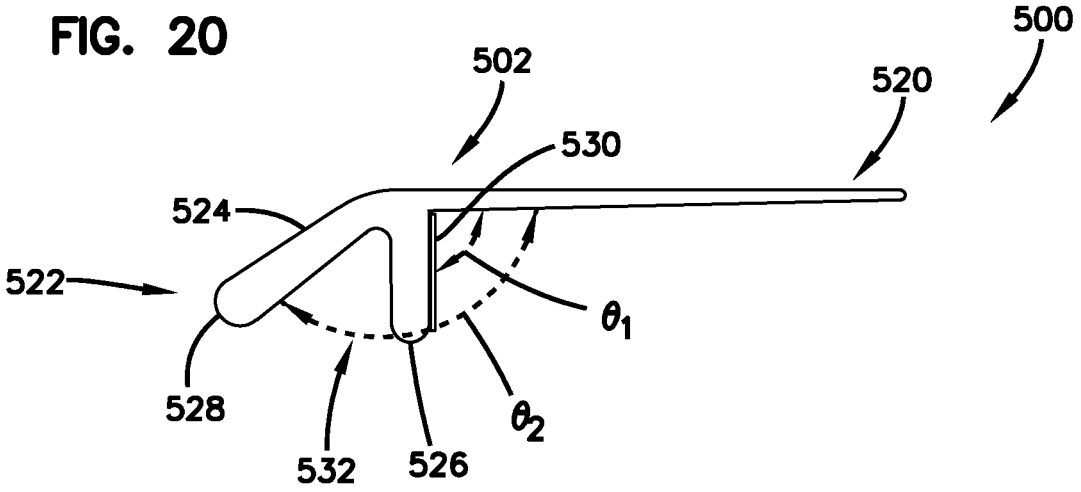
FIG. 20 is a cross-sectional view of an alternative configuration for the sealing system having exemplary features in accordance with the present disclosure.
Figure 21:
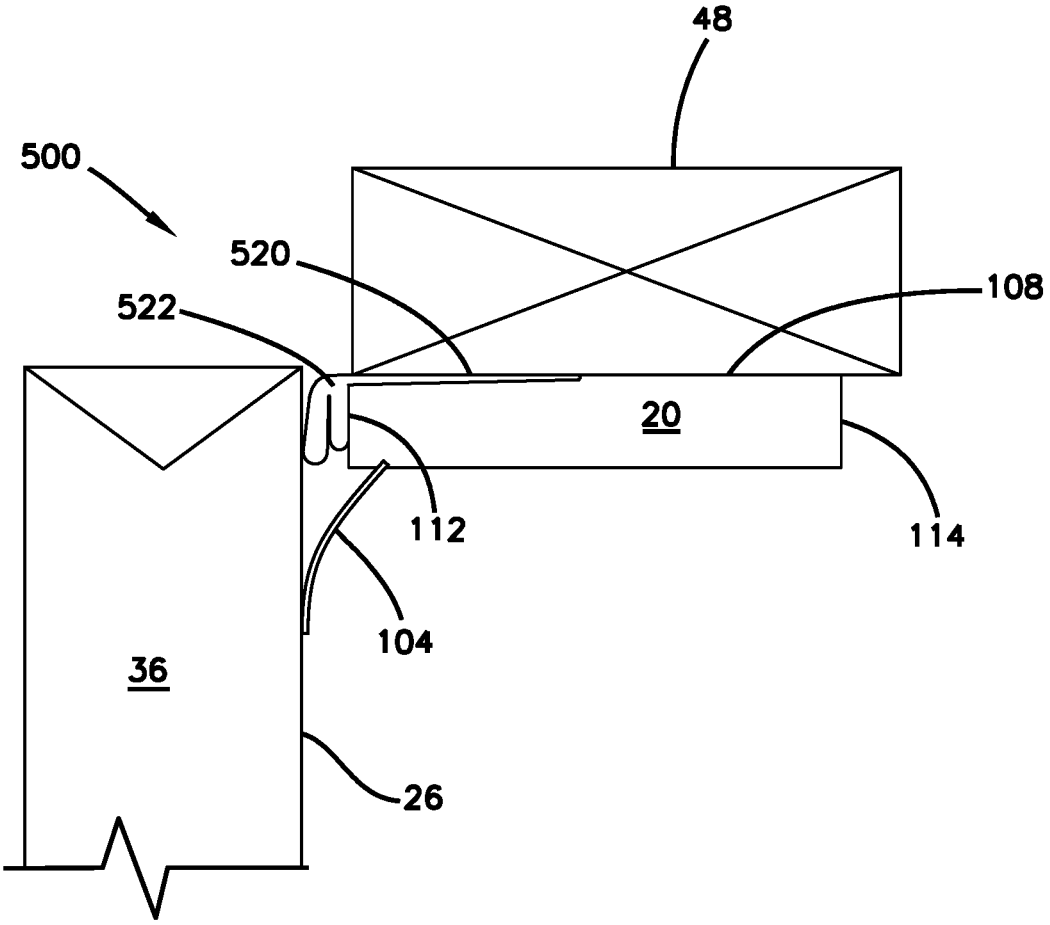
FIG. 21 is a cross-sectional view of the alternative configuration of FIG. 20 installed between an overhead door and a frame.

FIG. 20 is a cross-sectional view of a sealing system 500 having exemplary features in accordance with the present disclosure. FIG. 21 is a cross-sectional view of the sealing system 500 installed between an overhead door 26 and a frame 48. As shown in FIGS. 20 and 21, the sealing system 500 includes a sealing member 502 having a first sealing portion 520 and a second sealing portion 522 that extends continuously from the first sealing portion 520. The sealing member 502 is made from a compressible foam material. In some examples, the foam material is an open cell foam material that is closed with a slip seal layer to reduce friction between the sealing member 502 and the overhead door 26.

The first sealing portion 520 has a tapered design that is insertable between the jamb 20 and the frame 48. The first sealing portion 520 compresses when the jamb 20 is fixed to the frame 48. The tapered design of the first sealing portion 520 creates an impermeable seal in the space between the jamb 20 and the frame 48, while also allowing a leading edge between the first face 108 and the second side 114 of the jamb 20 to contact the framing 48. Advantageously, the tapered design prevents debris from entering the space between the jamb 20 and the frame 48, and maintains the aesthetic appearance of the jamb 20 and frame 48 when installed together.

The second sealing portion 522 include a first leg 526 and a second leg 528. A groove 532 extends between the first leg 526 and the second leg 528. The groove 532 defines a space when the second sealing portion 522 is in an uncompressed state (see FIG. 20).

The first leg 526 includes a pressure sensitive adhesive 530 that allows the sealing system 500 to attach to the jamb 20 before the jamb 20 is fixed to the frame 48, which eases the installation of the sealing system 500. The first leg 526 and pressure sensitive adhesive 530 are substantially orthogonal to the first sealing portion 520 and extend in a direction toward the sealing member 104 of the jamb 20 when the sealing system 500 is installed (see FIG. 21).

The second leg 528 has a sealing surface 524 that extends in a direction toward the sealing member 104 of the jamb 20 when the sealing system 500 is installed. The sealing surface 524 may include the slip seal layer (described above) that is waterproof and inhibits sticking and/or freezing to the overhead door 26 of the storage enclosure 10. For example, the slip seal layer may include a nylon or Teflon coating, a polyethylene film, or similar material.

As shown in FIG. 20, the first leg 526 extends from the first sealing portion 520 at a first angle θ1, and the second leg 528 extends from the first sealing portion 520 at a second angle θ2, and the second angle θ2 is larger than the first angle θ1. The first angle θ1 and second angle θ2 extend in the same direction relative to the first sealing portion 520. In some examples, the first angle θ1 is about 90 degrees and the second angle θ2 is in a range from 90 degrees to 180 degrees. In some examples, the second angle θ2 is about 135 degrees, and in some examples the second angle θ2 is 135 degrees.

When the overhead door 26 is moved to the closed position, the sealing surface 524 of the second leg 528 contacts the overhead door 26, and the overhead door 26 compresses the second sealing portion 522 such that the space defined by the groove 532 between the first leg 526 and the second leg 528 is eliminated or substantially reduced when the second sealing portion 522 is in a compressed state. When in the compressed state, the second sealing portion 522 provides an impermeable seal in the space between the overhead door 26 and the jamb 20. Advantageously, the shape and orientation of the first and second legs 526, 528 reduce the drag on the sealing system 500 making it easier to open and close the overhead door 26.

In accordance with the forgoing description, the first sealing portion 520 of the sealing system 500 provides a seal between the jamb 20 and the frame 48, while the second sealing portion 522 of the sealing system 500 provides a seal between the overhead door 26 and the jamb 20. These seals reduce air flow between the interior 16 and the exterior of the storage enclosure 10, which may help to improve the energy efficiency of the storage enclosure 10.

Figure 22:
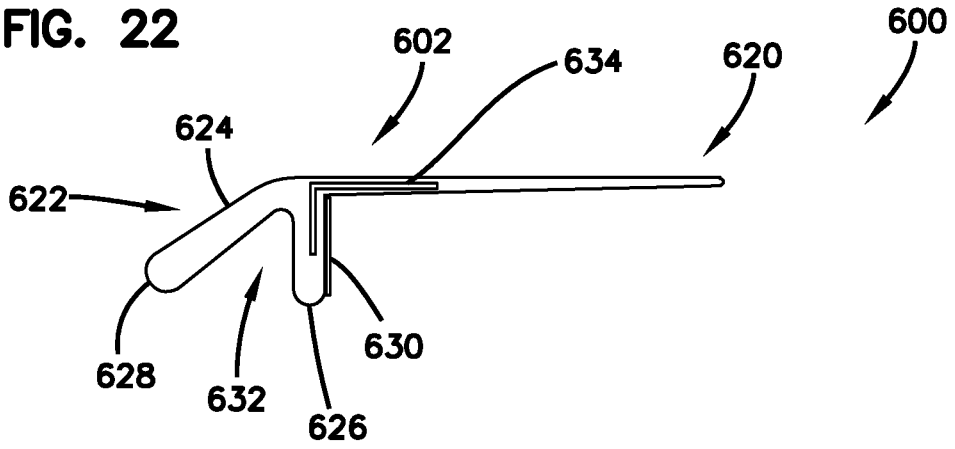
FIG. 22 is a cross-sectional view of an alternative configuration for the sealing system having exemplary features in accordance with the present disclosure.
Figure 23:
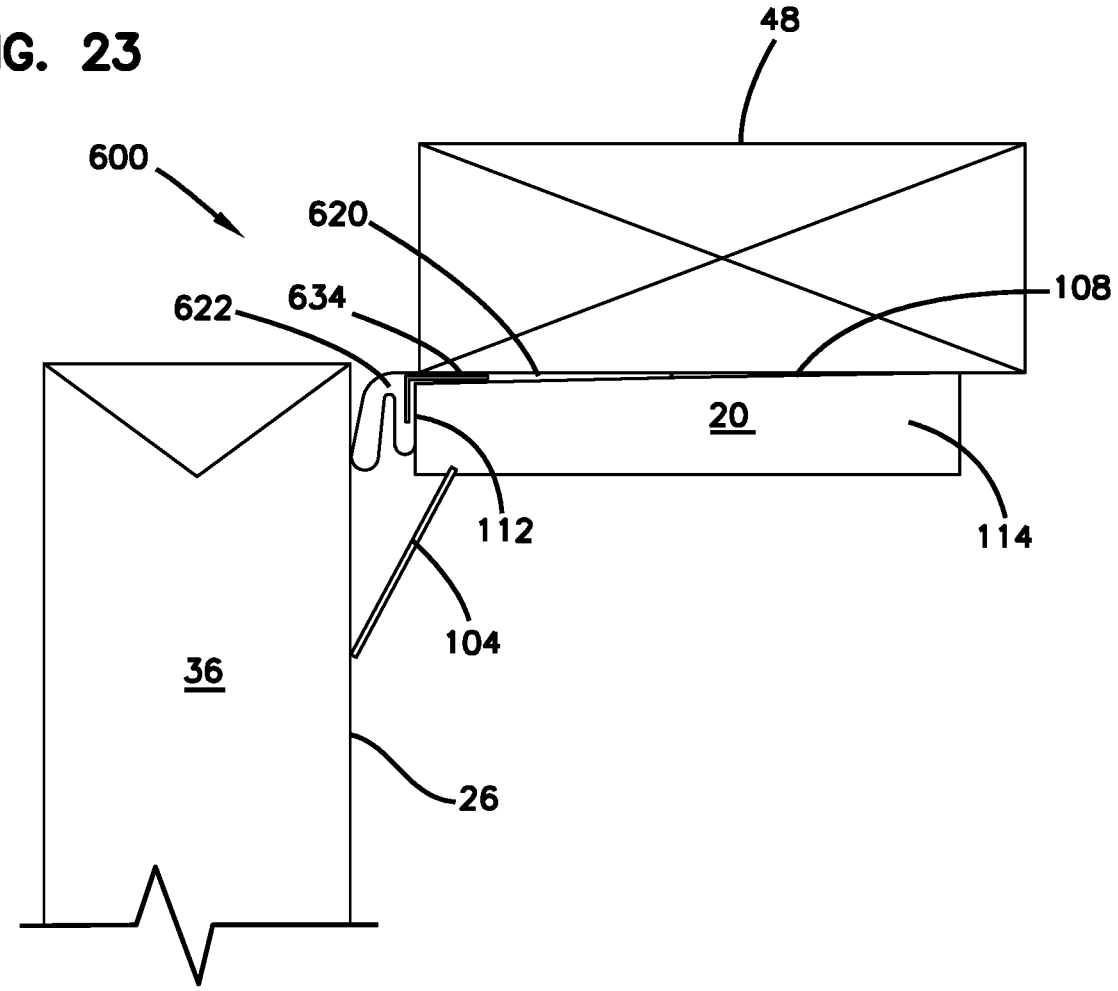
FIG. 23 is a cross-sectional view of the alternative configuration of FIG. 22 installed between an overhead door and a frame.

FIG. 22 is a cross-sectional view of a sealing system 600 having exemplary features in accordance with the present disclosure. FIG. 23 is a cross-sectional view of the sealing system 600 installed between an overhead door 26 and a frame 48. As shown in FIGS. 22 and 23, the sealing system 600 is similar to the sealing system 500 described above. For example, the sealing system 600 includes a sealing member 602 having a first sealing portion 620 and a second sealing portion 622 both made from a compressible foam material. The compressible foam material may include an open cell foam material that is closed with a slip seal layer to reduce friction between the sealing member 602 and the overhead door 26.

The first sealing portion 620 has a tapered design that is insertable between the jamb 20 and the frame 48. When the jamb 20 is fixed to the frame 48, the first sealing portion 620 is compressed, creating an impermeable seal in the space between the jamb 20 and the frame 48, while also allowing a leading edge between the first face 108 and the second side 114 of the jamb 20 to contact the framing 48. Advantageously, the tapered design prevents debris from entering the space between the jamb 20 and the frame 48, and maintains the aesthetic appearance of the jamb 20 and frame 48 when installed together.

The second sealing portion 622 include a first leg 626 and a second leg 628. The first leg 626 includes a pressure sensitive adhesive 630 that simplifies installation of the sealing system 600. The first leg 626 is substantially orthogonal to the first sealing portion 620 and extends in a direction toward the sealing member 104 of the jamb 20 when the sealing system 600 is installed to the frame 48 (see FIG. 23).

Additionally, the first leg 626 includes an insert 634 made of solid material. The insert 634 adds rigidity to the sealing system 600 to make the sealing system easier to handle and install. As shown, the insert 634 has an elbow shape and extends between the first sealing portion 620 and the first leg 626. In some examples, the insert 634 is made from a plastic or metal.

The second leg 628 has a sealing surface 624 that extends in a direction toward the sealing member 104 of the jamb 20, and a groove 632 extends between the first leg 626 and the second leg 628. When the overhead door 26 is moved to the closed position, the sealing surface 624 of the second leg 628 contacts the overhead door 26, and the overhead door 26 compresses both the first leg 626 and the second leg 628 of the second sealing portion 622 such that the space defined by the groove 632 between the first leg 626 and the second leg 628 is eliminated or substantially reduced.

In accordance with the forgoing description, the first sealing portion 620 of the sealing system 600 provides a seal between the jamb 20 and the frame 48, while the second sealing portion 622 of the sealing system 600 provides a seal between the overhead door 26 and the jamb 20. These seals reduce air flow between the interior 16 and the exterior of the storage enclosure 10, which may help to improve the energy efficiency of the storage enclosure 10.

Figure 24:
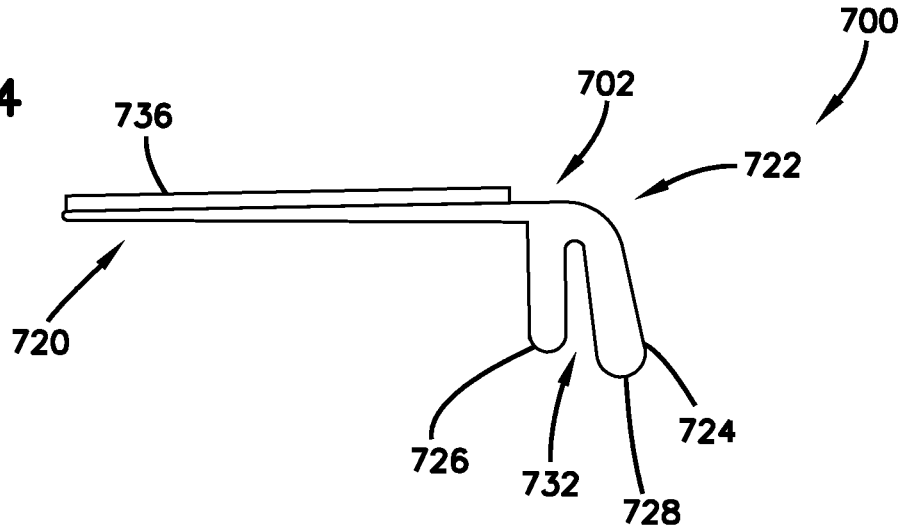
FIG. 24 is a cross-sectional view of an alternative configuration for the sealing system having exemplary features in accordance with the present disclosure.
Figure 25:
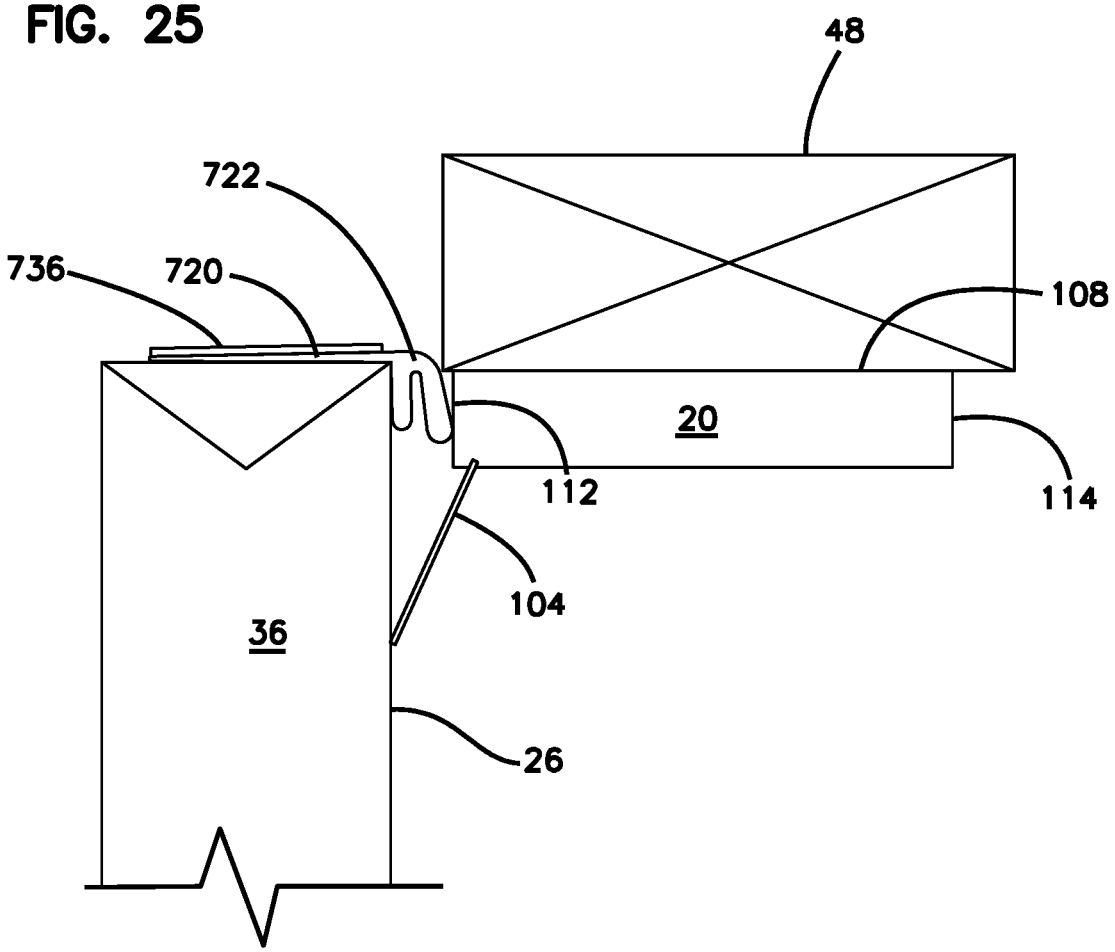
FIG. 25 is a cross-sectional view of the alternative configuration of FIG. 24 installed onto an overhead door.

FIG. 24 is a cross-sectional view of a sealing system 700 having exemplary features in accordance with the present disclosure. FIG. 25 is a cross-sectional view of the sealing system 700 installed onto an overhead door 26. As shown in FIGS. 24 and 25, the sealing system 700 is similar to the sealing systems 500 and 600 described above. For example, the sealing system 700 includes a sealing member 702 having a first sealing portion 720 and a second sealing portion 722 both made from a compressible foam material. The compressible foam material may include an open cell foam material that is closed with a slip seal layer to reduce friction between the sealing member 702 and the overhead door 26.

The first sealing portion 720 includes a backing plate 736. The backing plate 736 is made from a solid material that compresses the foam material of the first sealing portion 720 when the backing plate 736 is fixed to a surface. For example, the backing plate 736 can be made from a hardened plastic or from a metal such as aluminum or stainless steel. The backing plate 736 can be fixed to a surface by fasteners including screws, nails, staples, and the like.

In the example depicted in FIG. 25, the backing plate 736 is used to secure the first sealing portion 720 to a side surface of a panel 36 of the overhead door 26. Although only one sealing system 700 is depicted in FIG. 25, a separate sealing system 700 may be attached to each side of each panel 36 of the overhead door 26 so that a seal is formed around the opening 18 of the storage enclosure 10 (see FIG. 1). As shown in FIG. 25, the sealing system 700 can be installed to the overhead door 26 without having to disassemble the jamb 20, and may be used to retrofit an existing storage enclosure that has a frame and jamb already installed.

In other alternative examples, the backing plate 736 can secure the first sealing portion 720 to a side surface of the frame 48 of the opening of the storage enclosure 10. In such alternative examples, the sealing system 700 can be installed to the frame 48 without having to disassemble the jamb 20, such that the sealing system 700 may still be used to retrofit an existing storage enclosure that has a frame and jamb already installed.

The second sealing portion 722 of the sealing member 702 include a first leg 726 and a second leg 728. The first leg 726 is substantially orthogonal to the first sealing portion 720 and extends in a direction toward the sealing member 104 of the jamb 20 when the sealing system 600 is installed to the overhead door 26 (see FIG. 25).

The second leg 728 has a sealing surface 724 that extends in a direction toward the sealing member 104 of the jamb 20, and a groove 732 extends between the first leg 726 and the second leg 728. When the overhead door 26 is moved to the closed position, the sealing surface 724 contacts the jamb 20, and the jamb 20 compresses both the first leg 726 and the second leg 728 of the second sealing portion 722 such that the space defined by the groove 732 between the first leg 726 and the second leg 728 is eliminated or substantially reduced. Thus, the second sealing portion 722 of the sealing system 700 provides a seal between the overhead door 26 and the jamb 20 that reduces air flow between the interior 16 and the exterior of the storage enclosure 10, which may help to improve the energy efficiency of the storage enclosure 10.

Figure 26:
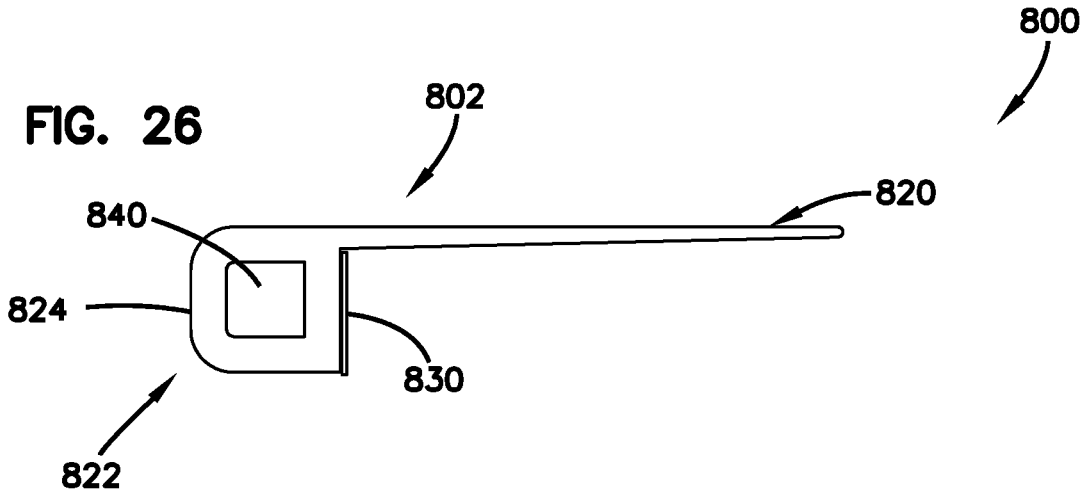
FIG. 26 is a cross-sectional view of an alternative configuration for the sealing system having exemplary features in accordance with the present disclosure.
Figure 27:
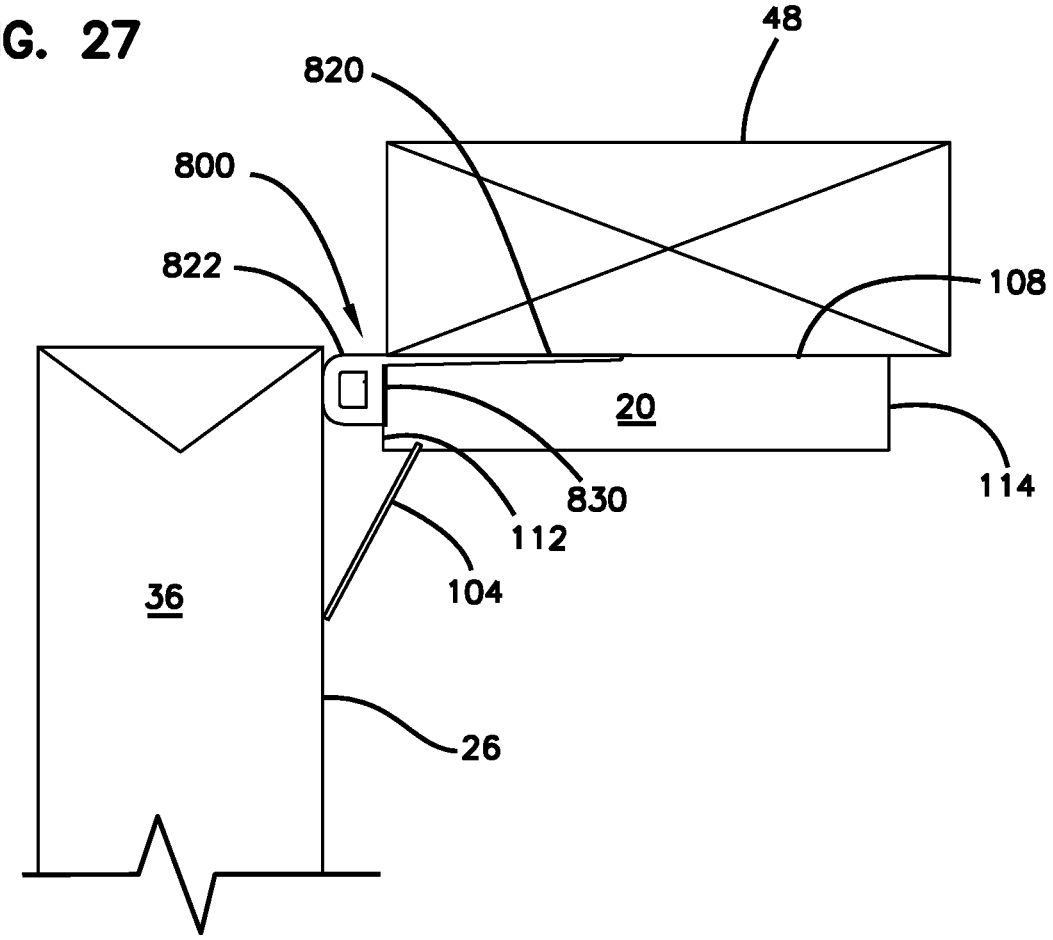
FIG. 27 is a cross-sectional view of the alternative configuration of FIG. 26 installed between an overhead door and a frame.

FIG. 26 is a cross-sectional view of a sealing system 800 having exemplary features in accordance with the present disclosure. FIG. 27 is a cross-sectional view of the sealing system 800 installed between an overhead door 26 and a frame 48. As shown in FIGS. 26 and 27, the sealing system 800 includes a sealing member 802 having a first sealing portion 820 and a second sealing portion 822 that extends continuously from the first sealing portion 820. The first and second sealing portions 820, 822 are made from a compressible foam material.

The first sealing portion 820 has a tapered design that is insertable between the jamb 20 and the frame 48. The first sealing portion 820 compresses when the jamb 20 is fixed to the frame 48. The tapered design of the first sealing portion 820 creates an impermeable seal in the space between the jamb 20 and the frame 48, while also allowing a leading edge between the first face 108 and the second side 114 of the jamb 20 to contact the framing 48. Advantageously, the tapered design prevents debris from entering the space between the jamb 20 and the frame 48, and maintains the aesthetic appearance of the jamb 20 and frame 48 when installed together.

The second sealing portion 822 has a tubular shape that defines a hollow portion 840 when the second sealing portion 822 is in an uncompressed state (e.g., FIG. 26). The hollow portion 840 may be substantially square in cross-sectional view when the second sealing portion 822 is in an uncompressed state. Other shapes and sizes are contemplated, including a cross-sectional "D" shape as well as other elliptical or polygonal cross-sectional shapes.

The second sealing portion 822 includes a pressure sensitive adhesive 830 that simplifies installation of the sealing system 800 by allowing the sealing system 800 to attach to the jamb 20 before the jamb 20 is fixed to the frame 48 during installation. The pressure sensitive adhesive 830 is attached to a surface of the second sealing portion 822 that is substantially orthogonal to the first sealing portion 820. The second sealing portion 822 also includes a sealing surface 824 that faces the exterior surface of the overhead door 26.

When the overhead door 26 is moved to the closed position, the sealing surface 824 contacts the overhead door 26, and the overhead door 26 compresses the second sealing portion 822 such that the hollow portion 840 is eliminated or substantially reduced when the second sealing portion 822 is in a compressed state. When in the compressed state, the second sealing portion 822 seals the space between the overhead door 26 and the jamb 20.

In accordance with the forgoing description, the first sealing portion 820 of the sealing system 800 provides a seal between the jamb 20 and the frame 48, while the second sealing portion 822 of the sealing system 800 provides a seal between the overhead door 26 and the jamb 20. These seals reduce air flow between the interior 16 and the exterior of the storage enclosure 10, which may help to improve the energy efficiency of the storage enclosure 10.

The various embodiments described above are provided by way of illustration only and should not be construed to limit the claims attached hereto. Those skilled in the art will readily recognize various modifications and changes that may be made without following the example embodiments and application illustrated and described herein, and without departing from the true spirit and scope of the following claims.

What is claimed is:

1. A sealing system for a storage enclosure, the sealing system comprising:

a sealing member having:

a first sealing portion that tapers from a first end to a second end, the first sealing portion shaped for insertion between a door jamb and a frame to create an impermeable seal in a space between the door jamb and the frame, while allowing a leading edge of the door jamb to contact the frame;

a second sealing portion that extends continuously from the first end of the first sealing portion, wherein the first sealing portion and the second sealing portion are made from a compressible foam material, the second sealing portion including:

a first leg extending orthogonally from the first sealing portion, the first leg having a pressure sensitive adhesive for attaching the sealing member to a side surface of the door jamb; and a second leg extending at an angle between 90 and 180 degrees from the first sealing portion, the second leg having a sealing surface that is configured to be engaged by an overhead door, the sealing surface having a slip seal layer that is waterproof and inhibits sticking and freezing to the overhead door; and a space defined between the first and second legs when the second sealing portion is in an uncompressed state, the space between the first and second legs being less than 90 degrees when the second sealing portion is in the uncompressed state, and wherein the space is eliminated when the second sealing portion is compressed by an exterior surface of the overhead door pushing against the sealing surface of the second leg.

2. The sealing system of claim 1, wherein the second leg extends from the first sealing portion by an angle of about 135 degrees.

3. The sealing system of claim 1, wherein the pressure sensitive adhesive is orthogonal to the first sealing portion.

4. The sealing system of claim 1, further comprising an insert made of solid material.

5. The sealing system of claim 4, wherein the insert has an elbow shape and extends between the first sealing portion and the first leg of the second sealing portion.

6. The sealing system of claim 1, further comprising a backing plate made of solid material.

7. The sealing system of claim 6, wherein the backing plate is configured to secure the first sealing portion to a side surface of an overhead door.

8. The sealing system of claim 6, wherein the backing plate is configured to secure the first sealing portion to a side surface of a frame of an opening of the storage enclosure.

9. The sealing system of claim 1, wherein the sealing system is an extruded component.

* * * * *